US008801356B2

(12) United States Patent
Gerber

(10) Patent No.: US 8,801,356 B2
(45) **Date of Patent: *Aug. 12, 2014**

(54) PIPE KICKER/INDEXER FOR PIPE HANDLING SYSTEMS

(75) Inventor: Andrew Virgil Gerber, Langdon (CA)

(73) Assignee: Markwater Handling Systems Ltd., Calgary (CA)

( * ) Notice: Subject to any disclaimer, the term of this patent is extended or adjusted under 35 U.S.C. 154(b) by 11 days.

This patent is subject to a terminal disclaimer.

(21) Appl. No.: 13/387,358

(22) PCT Filed: Jul. 29, 2010

(86) PCT No.: PCT/CA2010/001186

§ 371 (c)(1),
(2), (4) Date: Jan. 26, 2012

(87) PCT Pub. No.: WO2011/011887

PCT Pub. Date: Feb. 3, 2011

(65) Prior Publication Data

US 2012/0130537 A1 May 24, 2012

Related U.S. Application Data

(60) Provisional application No. 61/328,425, filed on Apr. 27, 2010, provisional application No. 61/229,630, filed on Jul. 29, 2009.

(51) Int. Cl.
*B66F 11/00* (2006.01)
*E21B 19/00* (2006.01)

(52) U.S. Cl.
USPC ..... 414/745.6; 414/22.57; 414/22.61; 414/22.62

(58) Field of Classification Search
USPC ..... 414/22.51–22.71, 745.1–746.8
See application file for complete search history.

(56) References Cited

U.S. PATENT DOCUMENTS

| | | | | |
|---|---|---|---|---|
| 3,792,783 | A * | 2/1974 | Brown | 414/22.62 |
| 3,810,553 | A * | 5/1974 | Crocker et al. | 414/22.61 |
| 3,844,420 | A * | 10/1974 | Walling et al. | 414/746.2 |
| 4,347,028 | A * | 8/1982 | Dugan | 414/22.61 |
| 4,371,302 | A * | 2/1983 | Frias et al. | 414/22.61 |
| 4,494,899 | A * | 1/1985 | Hoang et al. | 414/22.61 |
| 4,533,055 | A * | 8/1985 | Haney | 211/70.4 |
| 4,684,314 | A * | 8/1987 | Luth | 414/746.1 |
| 6,860,694 | B2 * | 3/2005 | Slettedal | 414/22.51 |

(Continued)

FOREIGN PATENT DOCUMENTS

JP 63282027 * 11/1988 ..... B65G 67/60

*Primary Examiner* — Gregory Adam
*Assistant Examiner* — Lynn Schwenning
(74) *Attorney, Agent, or Firm* — Christensen O'Connor Johnson Kindness PLLC

(57) ABSTRACT

A kicker/indexer is provided for a pipe handler for moving pipe to and from the drill floor of a drilling rig. The kicker/indexer includes a frame that is configured to attach to a catwalk, a push block drive assembly for receiving and pushing pipe towards a trough located on the catwalk, and a kicker drive assembly for pushing pipe out of the trough. A pipe handler is provided that includes a catwalk attached to a lower frame with a pair of scissor-legs and a trough nested therein, the trough having an end that can be raised and moved towards the drill floor. The trough can further have a skate slidably disposed thereon to pushing pipe on the trough towards to the drill floor.

42 Claims, 20 Drawing Sheets

(56) References Cited

U.S. PATENT DOCUMENTS

| | | | | |
|---|---|---|---|---|
| 6,994,505 | B2 * | 2/2006 | Hawkins, III | 414/22.54 |
| 7,473,065 | B2 * | 1/2009 | Wells | 414/22.57 |
| 2006/0285941 | A1 * | 12/2006 | Fikowski et al. | 414/22.54 |
| 2007/0031215 | A1 * | 2/2007 | Belik | 414/22.62 |
| 2007/0177967 | A1 * | 8/2007 | Lesko | 414/746.1 |
| 2009/0053013 | A1 * | 2/2009 | Maltby | 414/22.61 |
| 2009/0196711 | A1 * | 8/2009 | Gerber et al. | 414/22.58 |
| 2011/0259640 | A1 * | 10/2011 | Gerber | 175/52 |

* cited by examiner

PIPE KICKER/INDEXER FOR PIPE HANDLING SYSTEMS

CROSS REFERENCE TO RELATED APPLICATIONS

This application claims priority of U.S. provisional patent application Ser. No. 61/229,630 filed Jul. 29, 2009 and Ser. No. 61/328,425 filed Apr. 27, 2010, and hereby incorporates the same provisional applications by reference herein in their entirety.

TECHNICAL FIELD

The present disclosure is related to the field of oil well operations, in particular, pipe handling systems for moving pipe to and from the drill floor on an offshore drilling rig, and kicker/indexer systems for moving pipe onto and off of the pipe handling systems.

BACKGROUND

On drilling rigs, in particular, offshore Jack-Up drilling rigs, drill pipe can be stored in tiered pipe stacks or racks behind stanchions known as "Samson posts" on the cantilever pipe deck. On typical offshore rigs, cranes are utilized to lift singles or bundles of pipe from the pipe racks to a catwalk on a pipe handler or up to the drill floor. This process requires people to work in and around these suspended loads to hook up bundles of pipe. This is a hazardous job where workers are prone to injury.

In the traditional way of kicking pipe out of the trough, a "kicker", as shown in US Patent application 2006/0285941 is mounted into the trough and actuated through cut outs in the trough. The problem with this design is it creates a transition seam which when laying down pipe on to the trough the threaded end of the pipe, whether protected with a thread protector or not, will catch on. If the engagement of the pipe on this seam is firm enough it can the cause the pipe to bounce sideways relative to the trough. In an extreme situation the pipe is capable of bouncing sideways far enough to jump off the trough entirely and thus be free to fall to the ground or swing back towards the drill floor edge.

Also shown in the above cited US Patent application are manually adjusted pins utilized to aid in indexing a single pipe from a row of pipe on tilted pipe racks onto the catwalk. These pins must be manually positioned in a series of locations each corresponding to a different diameter of pipe. To adjust the pins, a worker is required to get onto the catwalk or walk between the catwalk and the pipe on the pipe racks. This is a situation that can put the worker in a dangerous position.

It is, therefore, desirable to provide a pipe handler and a kicker/indexer that overcomes the shortcomings of prior art pipe-handling devices, and provides for the safe and efficient movement of pipe on a drilling rig.

SUMMARY

A kicker/indexer for use on a catwalk for a pipe handler to move pipe on a drilling rig is provided. In some embodiments, the kicker/indexer can comprise a frame configurable for mounting on catwalks of various shapes and sizes. The kicker/indexer can comprise a back stop for resting pipe against and a push block and a push block drive assembly that enables the push block to move along a top surface of the kicker/indexer for moving or "indexing" pipe into a trough located on the catwalk. In some embodiments, the kicker/indexer can further comprise a retractable pipe dog that can extend upwards from the top surface to hold pipe away from the backstop. In some embodiments, the kicker/indexer can comprise a retractable kicker arm that can extend from the frame to push pipe out of the trough.

In some embodiments, one or more kick/indexers can be mounted on a catwalk that can be further elevated on a pipe handler for presenting pipe to a drilling rig floor. The catwalk can be coupled to a lower frame with scissor legs that can move the catwalk up or down relative to the lower frame. A trough can be nested in a trough track disposed along a longitudinal axis of the catwalk. In other embodiments, the trough can be lifted at one end by a trough lift assembly disposed in the catwalk. In further embodiments, the trough can move in the trough track to further extend the trough towards the drilling rig floor. In some embodiments, the pipe handler can comprise a skidding system that can move side-to-side as well as fore and aft so that the pipe handler can move pipe between pipe racks located on the pipe deck to the elevated drilling rig floor.

Broadly stated, in some embodiments, a kicker/indexer for a pipe handler comprising a catwalk and a trough configured to receive pipe, the trough disposed along a longitudinal axis extending along the catwalk, the kicker/indexer comprising: a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame; a push block assembly for indexing or moving pipe along the top surface from the backstop to the trough; and a kicker assembly for kicking out pipe located in the trough.

Broadly stated, in some embodiments, an improved pipe handler comprising a catwalk for use on a pipe deck on a drilling rig, the pipe handler configured for moving pipe disposed on the pipe deck to a drilling rig floor, the improvement comprising at least one kicker/indexer disposed on the catwalk, the at least one kicker/indexer comprising: a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame; a push block assembly for indexing or moving pipe along the top surface from the backstop to the trough; and a kicker assembly for kicking out pipe located in the trough.

Broadly stated, in some embodiments, a pipe handler for use on a pipe deck on a drilling rig for moving pipe disposed on the pipe deck to a drilling rig floor, comprising: a catwalk operatively coupled to a lower frame with a pair of scissor legs wherein the catwalk can be raised and lowered with respect to the lower frame by operating a scissor legs drive assembly operatively coupled to the scissor legs, the catwalk further comprising: a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame, a push block assembly for indexing or moving pipe along the top surface from the backstop to the trough, and a kicker assembly for kicking out pipe located in the trough; a trough nested within a trough guide track disposed along a longitudinal axis of the catwalk, the trough comprising two ends, a first end disposed nearer the drilling rig floor and a second end disposed away from the drilling rig floor, the trough configured to move within the trough guide track; a trough lift drive assembly disposed within the catwalk, the trough lift drive assembly configured to raise the first end of the trough; and a trough drive assembly disposed with the catwalk, the trough drive assembly operatively coupled to the second end and configured to move the trough along the trough guide track.

DETAILED DESCRIPTION OF EMBODIMENTS

Figure 1:
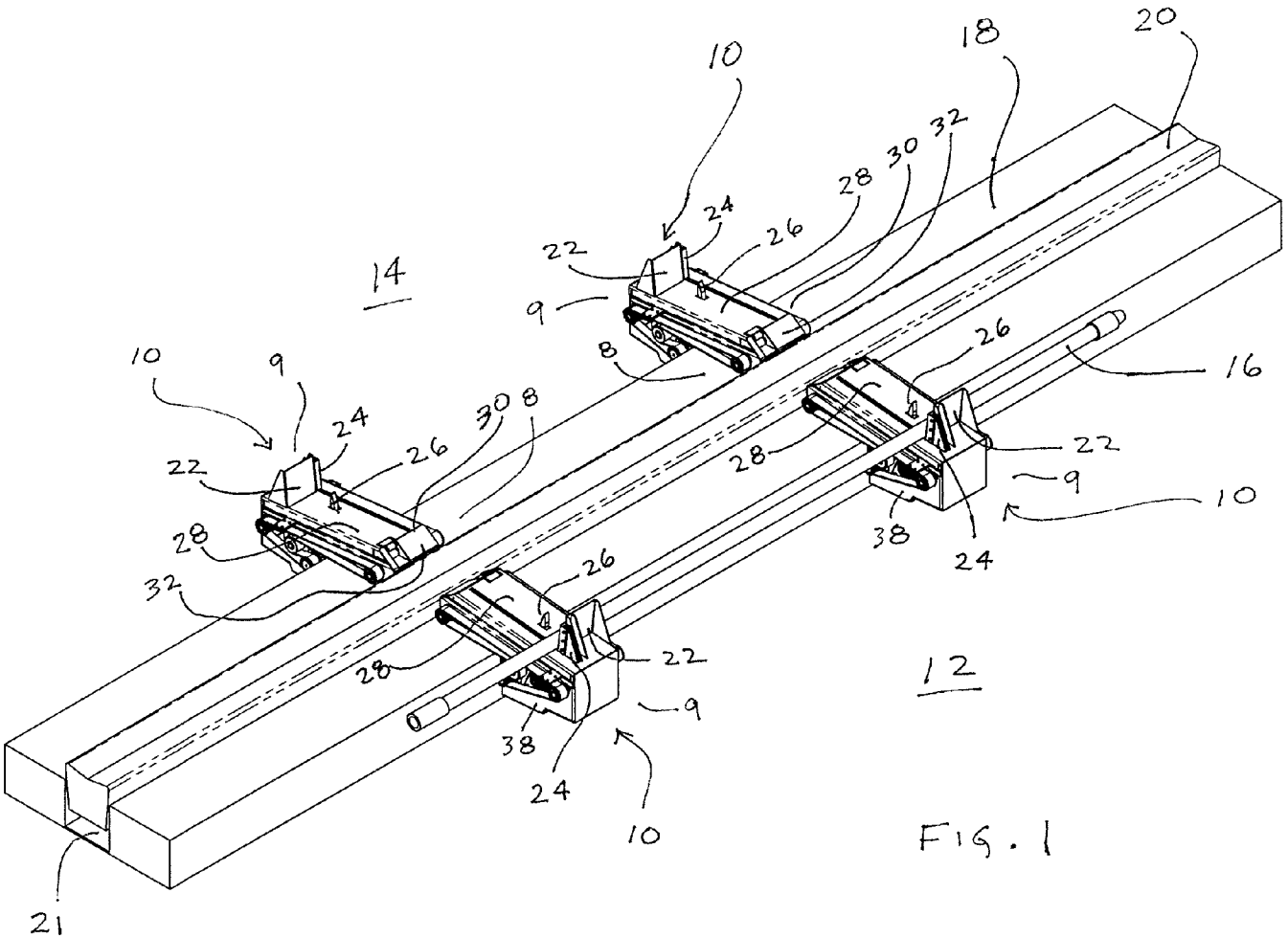
FIG. 1 is a perspective view depicting a catwalk with a trough for a pipe handling system having four pipe kicker/indexers disposed thereon.
Figure 2:
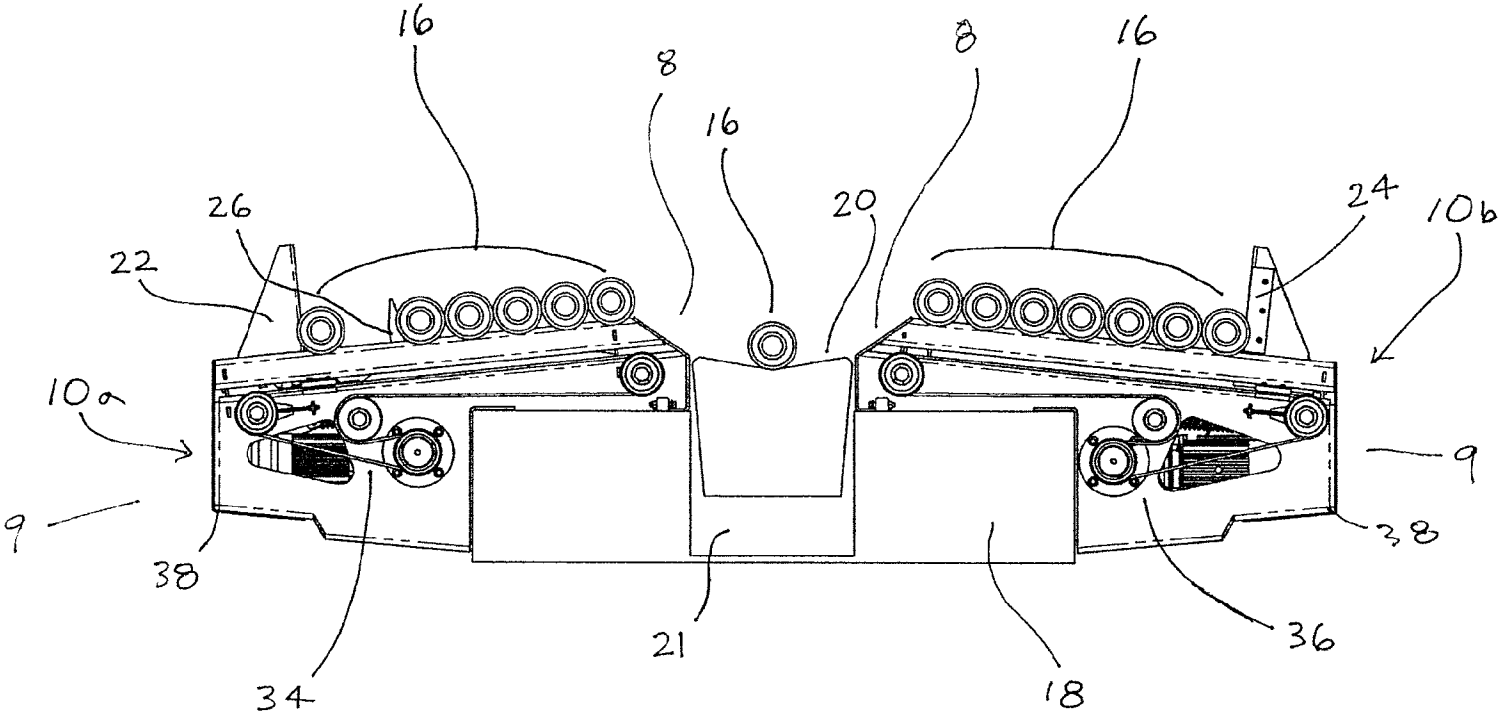
FIG. 2 is an end elevation view depicting the catwalk of FIG. 1 with pipe placed on the kicker/indexers and in the trough.

In a broad aspect, a kicker/indexer is provided for a pipe handler for moving pipe to and from the drill floor of a drilling rig. Referring to FIGS. 1 and 2, catwalk 18 of a pipe handler is shown. Catwalk 18 can comprise trough 20, which can be glidably disposed and nested in guide track 21. One embodiment of kicker/indexer 10 can be attached to catwalk 18 in a plurality of locations.

In one embodiment, as illustrated in FIG. 1, four kicker/indexers 10 can be disposed on catwalk 18, two on each side opposing each other. Kicker/indexer 10 can comprise frame 38 that can be configured to be removably attached to catwalk 18 thereby allowing kicker/indexer 10 to be configurable and adaptable by those skilled in the art with little or no effort so it can be used with catwalks of various manufacture.

In some embodiments, each kicker/indexer 10 can comprise trough end 8 that is disposed nearer trough 20 and catwalk end 9 that is disposed away from trough 20. Each kicker/indexer 10 can further comprise top surface 28, backstop 22 disposed near catwalk end 9, push block 24 slidably disposed on top surface 28, pipe dog 26 that can extend upwardly from and retract downwardly into top surface 28. In some embodiments, top surface 28 can be inclined, sloping downwardly from trough end 8 to catwalk end 9. In other embodiments, trough end 8 can further comprise ramp face 32 that can intersect with top surface 28 at knee 30 therein forming a ramp that continues from the inclined, shallow "V" profile of trough 20. In some embodiments, kicker/indexer 10 can further comprise kicker drive assembly 34 for operating a kicker mechanism, and push block drive assembly 36 for moving push block 24 along top surface 28. As shown in FIG. 2, catwalk 18 has kicker/indexer 10*a* disposed on a left side thereof, and kicker/indexer 10*b* disposed on a right side thereof. A plurality of pipe 16 is shown placed on top of both kicker/indexers. Kicker/indexer 10*a* is also known having a single pipe 16 resting against backstop 22 and a plurality of pipe 16 resting against pipe dog 26.

Figure 3:
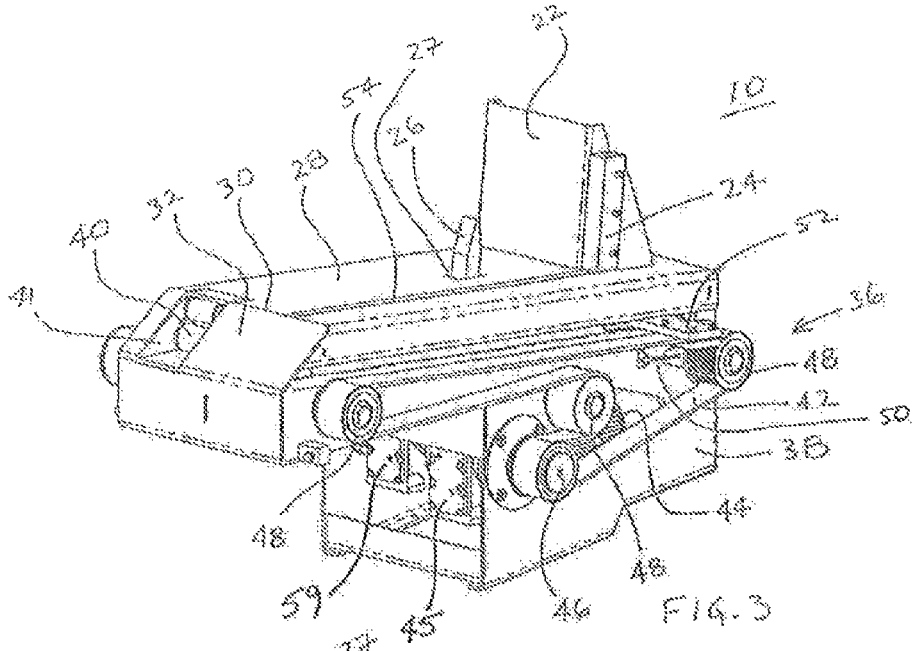
FIG. 3 is a front perspective view depicting the kicker/indexer shown in FIG. 1.
Figure 4:
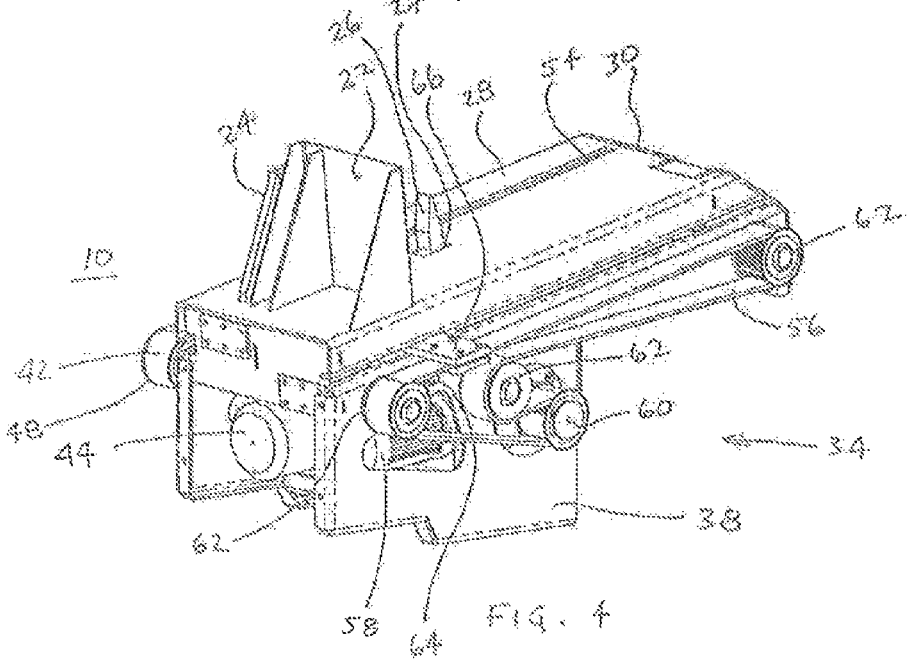
FIG. 4 is a rear perspective view depicting the kicker/indexer shown in FIG. 1.
Figure 5:
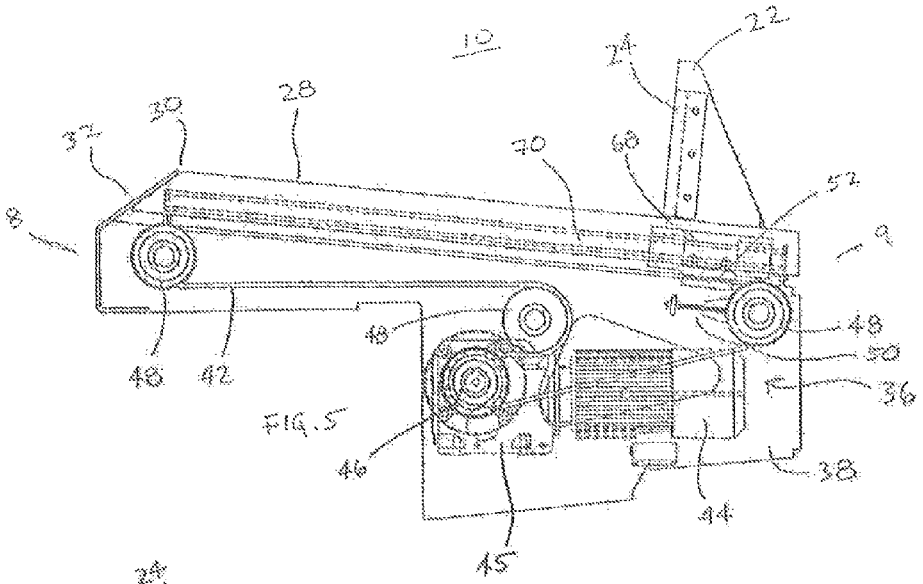
FIG. 5 is a left side elevation view depicting the kicker/indexer shown in FIG. 3 with the push block retracted.
Figure 6:
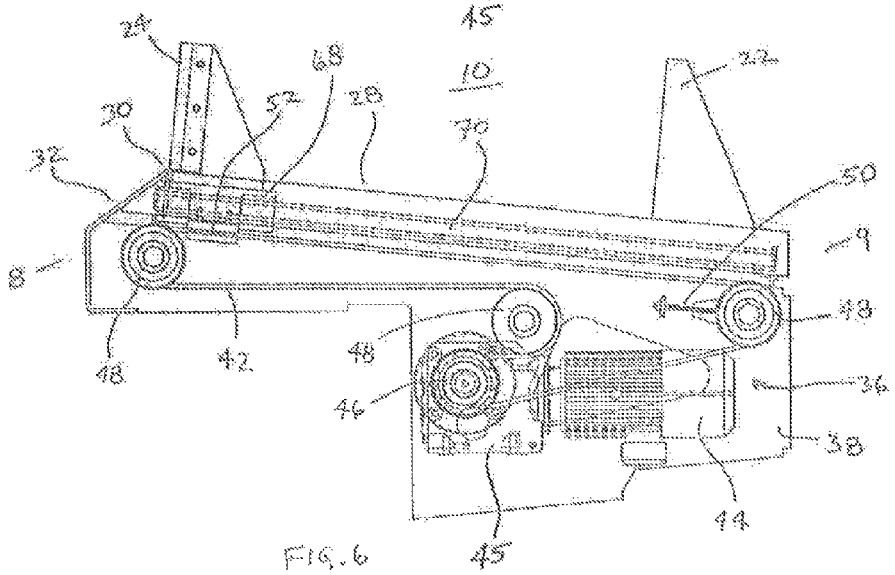
FIG. 6 is a left side elevation view depicting the kicker/indexer shown in FIG. 3 with the push block extended.

Referring to FIGS. 3 through 10, an embodiment of kicker/indexer 10 is shown in more detail. In some embodiments, kicker/indexer 10 can comprise push block drive assembly 36 for moving push block 24. Drive assembly 36 can comprise motor 44 configured to turn drive pulley 46. Drive pulley 46 can move belt 42 around a plurality of idler pulleys 48 rotatably disposed on frame 38. Belt tensioner 50 can be disposed on one pulley 48 to ensure proper tension in belt 42. As shown in FIG. 3, push block 24 can move along guide track slot 54 disposed on top surface 28. Referring to FIG. 5, push block 24 can comprise guide block 68 slidably disposed on guide rail 70 disposed within frame 38 beneath guide slot 54. Guide block 68 can further comprise attachment plate 52 that can clamp to belt 42. In operation, motor 44 can move belt 42 by rotating drive pulley 46 via transmission 45. In FIG. 5, push block 24 is shown substantially aligned with backstop 22 near catwalk end 9. When motor 44 rotates belt 42 counter-clockwise, push block guide block 68 is pulled along guide rail 70 by virtue of attachment plate 52 clamped to belt 42 thereby moving push block 24 along guide track slot 54 towards trough end 8, as shown in FIG. 6. To move push block 24 back towards catwalk end 9, motor 44 can reverse direction and move belt 42 clockwise.

Figure 7:
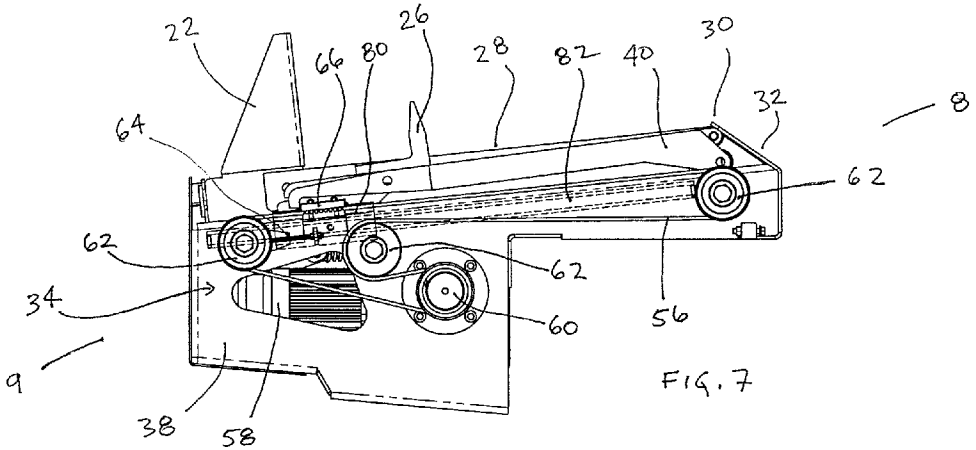
FIG. 7 is a right side elevation view depicting the kicker/indexer shown in FIG. 3 with the kicker arm retracted.
Figure 8:
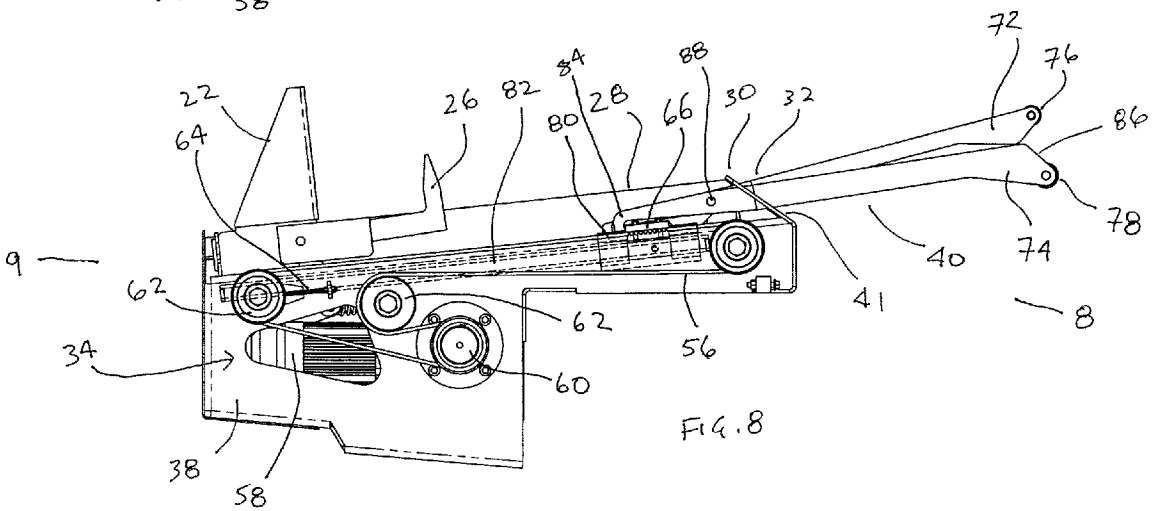
FIG. 8 is a right side elevation view depicting the kicker/indexer shown in FIG. 3 with the kicker arm extended.

In some embodiments, kicker/indexer 10 can comprise kicker 40 and kicker drive assembly 34, as shown in FIGS. 4, 7 and 8. Similar to push block drive assembly 36, kicker drive assembly 34 can comprise motor 58 that can be configured to rotate drive pulley 60 via transmission 59 (as shown in FIG. 3) to move belt 56 around a plurality of idler pulleys 62. Belt tensioner 64 can be disposed on one pulley 62 to ensure proper tension in belt 56.

Referring to FIGS. 7 and 8, kicker arm 40 can comprise reactor arm 84 operatively attached to guide block 80 that can be slidably disposed on guide rail 82. Guide block 80 can further comprise attachment plate 66 that can clamp to belt 56. In operation, motor 58 can move belt 56 by rotating drive pulley 60. In FIG. 7, kicker arm 40 is shown substantially retracted into frame 38 with attachment plate 66 clamped to belt 56 and positioned near catwalk end 9. When motor 58 rotates belt 56 clockwise, kicker guide block 80 is pulled along guide rail 82 by virtue of attachment plate 66 clamped to belt 56 thereby pushing kicker arm 40 out of frame 38 through opening 41 disposed on ramp face 32, as shown in FIG. 8. As kicker arm 40 is extended from frame 38, upper kicker arm 72 can pivot upwards about pin 88 with respect to lower kicker arm 74 to form a V-shaped profile between upper roller 76 and lower roller 78. To retract kicker arm 40 back into frame 38, motor 58 can reverse direction and move belt 56 counter-clockwise.

While the illustrated embodiments of kicker drive assembly 34 and push block drive assembly can use belts and pulleys, it is obvious to those skilled in the art that belts 42 and 56, and pulleys 46, 48, 60 and 62, can be replaced with functional equivalents. These equivalents can comprise chains and sprockets, cables and pulleys, intermeshing gears, rack and pinion gears or any combinations thereof. It is also obvious to those skilled in the art that motors 44 and 58 can be electric motors of any applicable variant, such as AC fixed frequency motors, AC variable frequency motors, DC motors, stepper motors or any other functionally equivalent motor including, but not limited to, hydraulic motors or pneumatic motors. In some embodiments, one or more of motors 44 and 58 can comprise a transmission or gear reducer to reduce or step down the rotation speed of the motors, respectively. In some embodiments, motors 44 and 58 can comprise internal or external transmissions or gear reducers that can comprise worm gear mechanisms, planetary gear mechanisms, intermeshing gear mechanisms, ring and pinion gear mechanisms, any combinations thereof or any other functionally equivalent mechanisms as known to those skilled in the art.

In some embodiments, the control and operation of kicker drive assembly 34 and push block drive assembly 36 can further comprise operational controls (not shown) that can permit the manual operation of one or more of kicker drive assembly 34 and push block drive assembly 36 and of multiple kicker/indexers 10 in tandem to move kicker arm 40 in and out of frame 38 and to move push block 24 along top surface 28. If motors 44 and 58 comprise electric motors, then the controls can comprise an electrical control panel to control the operation of the motors as known to those skilled in the art. If motors 44 and 58 comprise hydraulic or pneumatic motors, then the controls can comprise hydraulic or pneumatic control systems as known to those skilled in the art. In some embodiments, kicker/indexer 10 can further comprise at least one automated control mechanism (not shown), such as general purpose computers, programmable logic controllers, microprocessors, microcontrollers, hydraulic fluid control systems, pneumatic control systems or other functionally equivalents systems as known to those skilled in the art to monitor, control and operate one or more kicker/indexers 10, singly or in tandem, manually or as part of an automated system.

In some embodiments, kicker/indexer 10 can comprise one or more position sensors disposed on one or more of kicker drive assembly 34 and push block drive assembly 36 that are operatively connected to a control system, as known to those skilled in the art (not shown), the sensors disposed on kicker/indexer 10 to monitor the position and movement of push block 24 or kicker arm 40 for use in the control and operation of kicker/indexer 10. Suitable examples can include motion detectors or rotary encoders disposed on one or more of kicker drive assembly 34 and push block drive assembly 36 that can be monitored by a control system, or disposed within one or more of motors 44 and 58. Other examples can include one or more of electro-optical and magnetic components, as known to those skilled in the art, operatively connected to a control system.

Figure 9:
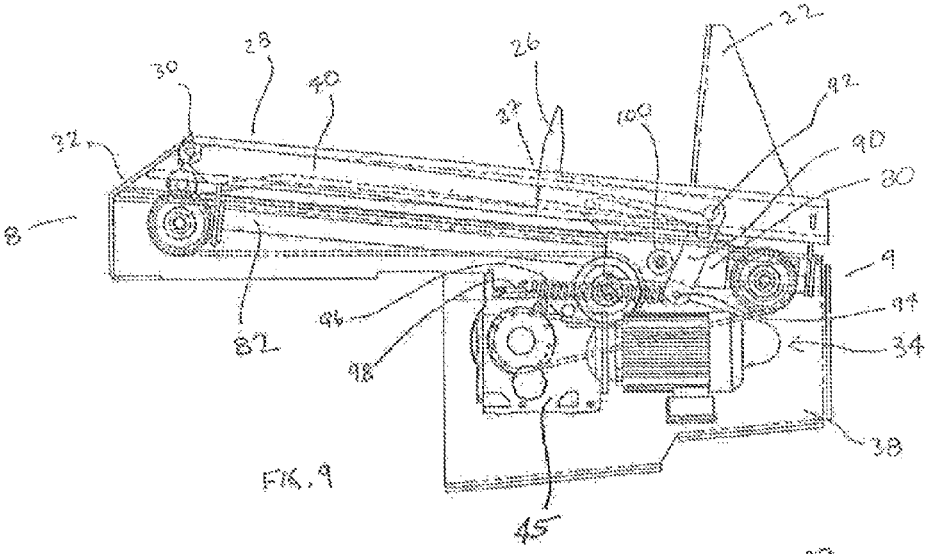
FIG. 9 is a left side elevation cut-away view depicting the kicker/indexer shown in FIG. 3 with the pipe dog extended upwards.
Figure 10:
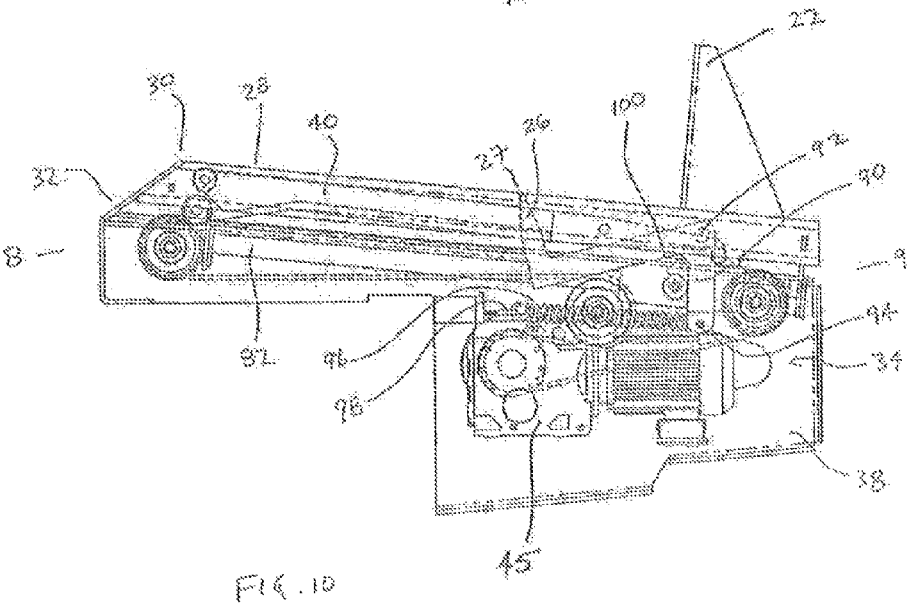
FIG. 10 is a left side elevation cut-away view depicting the kicker/indexer shown in FIG. 3 with the pipe dog retracted.

In some embodiments, kicker/indexer 10 can comprise pipe dog 26 that can extend upwards from top surface 28 through opening 27, and that can further retract into frame 38 through opening 27, as shown in FIGS. 3, 4, 9 and 10. Referring to FIGS. 9 and 10, pipe dog 26 can be operatively attached to dogleg member 90 that can pivotally attached to frame 38 via pivot pin 92. In other embodiments, pipe dog 26 can be biased in a position whereby pipe dog 26 is fully extended upwards through opening 27. In some embodiments, the bias mechanism can comprise spring 96 attached to spring mount 94 disposed on dogleg member 90 at one end, and attached to spring mount 98 disposed inside frame 38 on the other end. In this configuration, pipe dog 26 is urged upwards through opening 27.

In some embodiments, pipe dog 26 can be retracted down into frame 38. Referring to FIGS. 9 and 10, kicker guide block 80 can further comprise cam follower bearing 100 disposed thereon and configured to contact dogleg member 90. When motor 58 is operated to retract kicker arm 40 further into frame 38, cam follower bearing 100 can contact dogleg member 90 causing it to pivot about pivot pin 92 thereby causing pipe dog 26 to retract into frame 38 through opening 27. While the illustrated embodiment shows that pipe dog 26 can by operated by kicker arm 40 and kicker drive assembly 34, it is obvious to those skilled in the art that a separate and independent actuating mechanism (not shown) can be used to raise and lower pipe dog 26 through opening 27. Such mechanisms can comprise one or more of electromechanical motors, hydraulic motors, pneumatic motors, belts and pulleys, chains and sprockets, cables and pulleys, intermeshing gears, rack and pinion gears or any other functionally equivalent actuating mechanisms as well known to those skilled in the art.

Referring to FIGS. 11 through 18, the operation of kicker/indexers 10 on catwalk 18 is shown. As will be discussed in further detail below, catwalk 18 can be part of a pipe handler system that can be loaded with pipe 16 to be delivered up to a drilling rig floor. FIGS. 11 through 18 illustrate the process of how pipe can be loaded onto catwalk 18.

Figure 11:
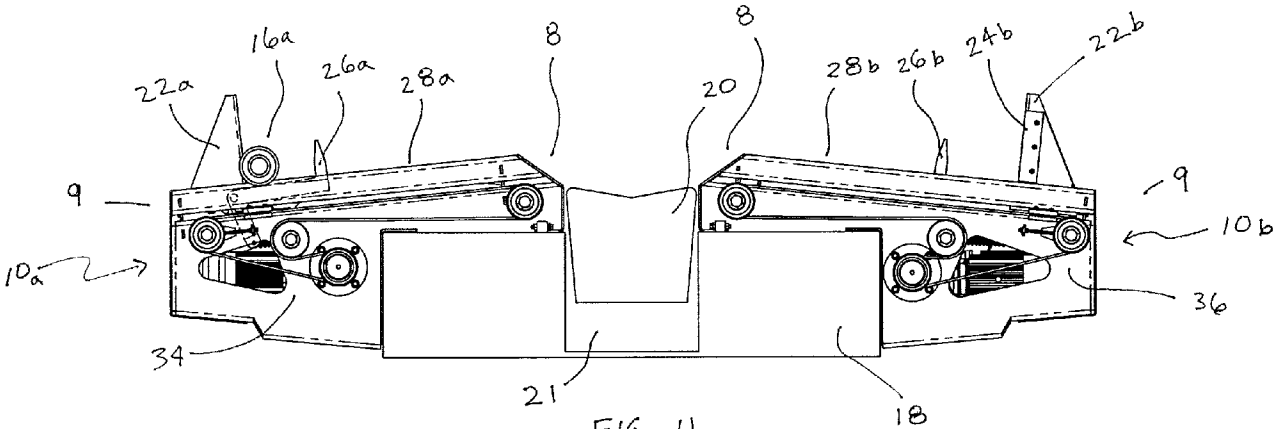
FIG. 11 is an end elevation view depicting the catwalk of FIG. 2 with a section of pipe placed against the left backstop.
Figure 12:
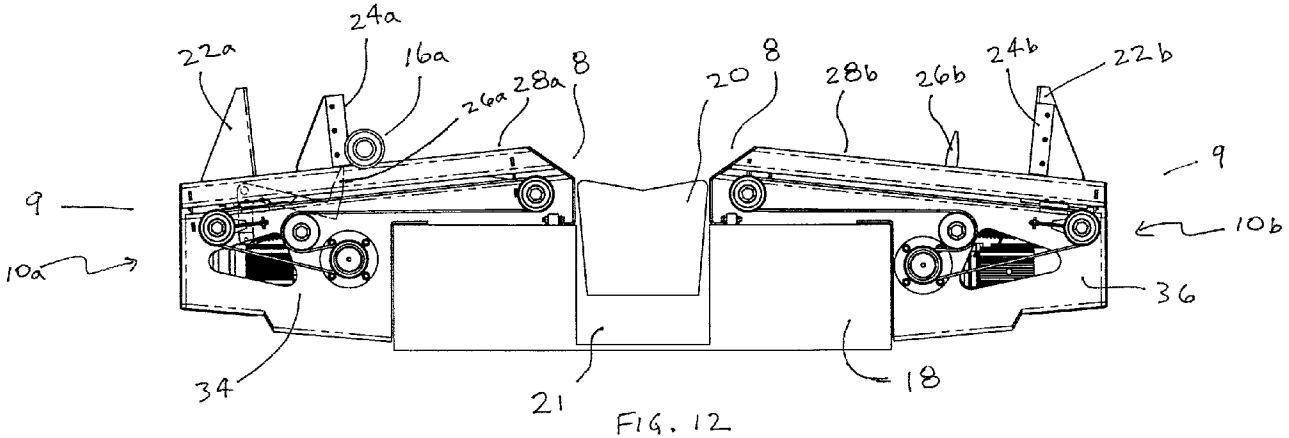
FIG. 12 is an end elevation view depicting the catwalk of FIG. 11 with the pipe pushed up the inclined top surface of the kicker/indexer.
Figure 13:
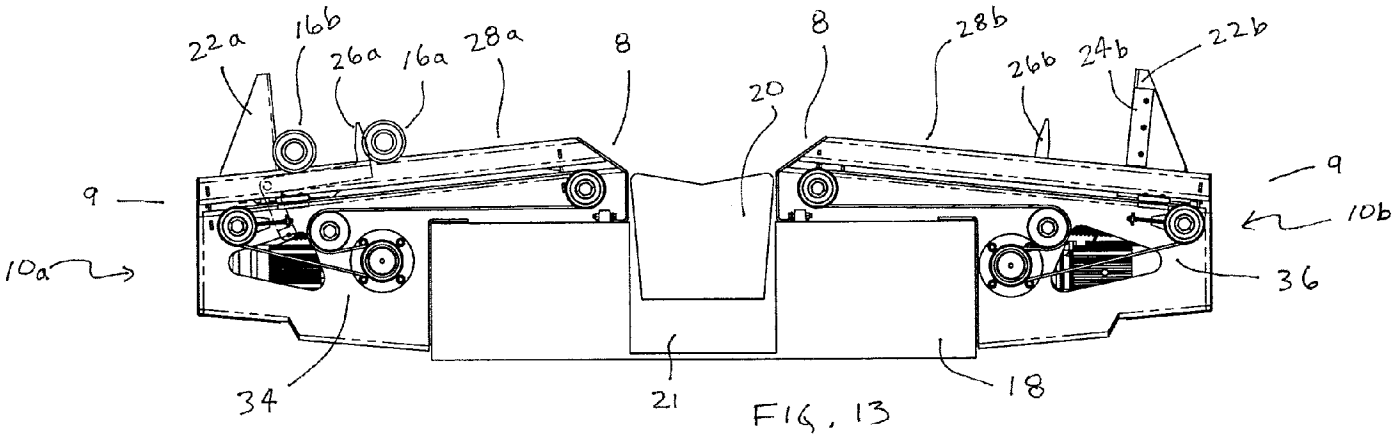
FIG. 13 is an end elevation view depicting the catwalk of FIG. 12 with the pipe resting against the left pipe dog and another section of pipe placed against the left backstop.
Figure 14:
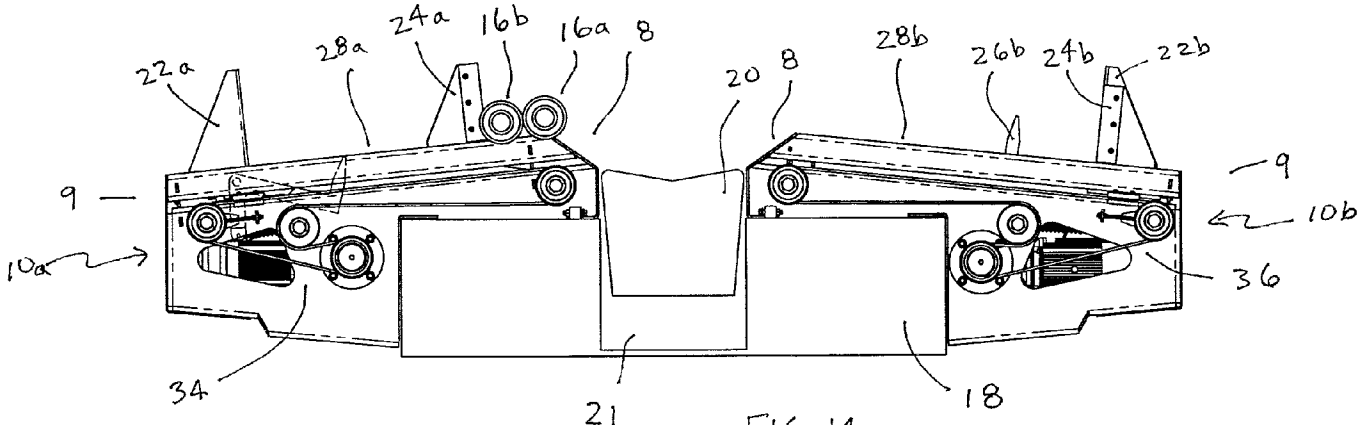
FIG. 14 is an end elevation view depicting the catwalk of FIG. 13 with both sections of pipe pushed towards the trough by the push block.
Figure 15:
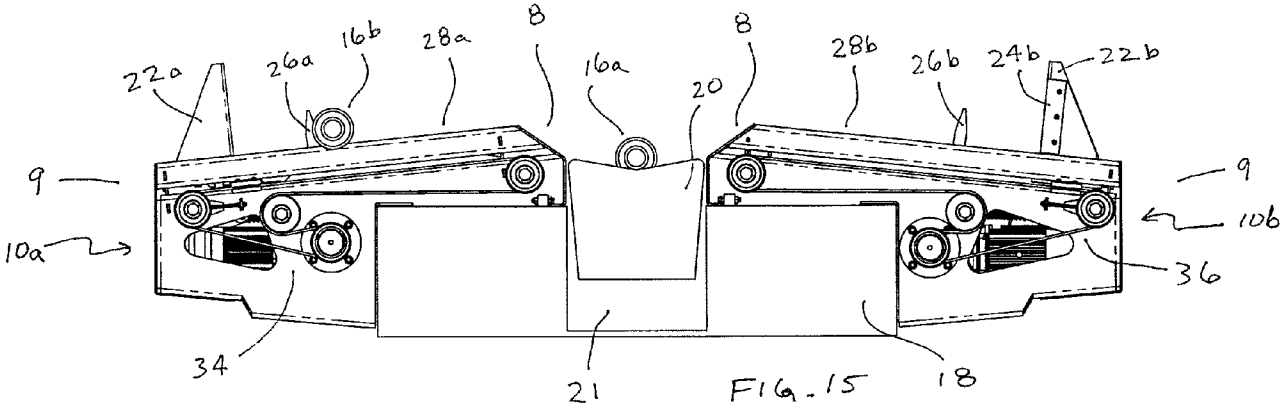
FIG. 15 is an end elevation view depicting the catwalk of FIG. 14 with one pipe in the trough and the other pipe resting against the left pipe dog.

In FIG. 11, pipe 16*a* can be placed on kicker/indexer 10*a* for moving onto kicker/indexer 10*b*. In this position, pipe 16*a* is resting on top surface 28*a* against backstop 22*a*. In FIG. 12, pipe dog 26*a* is retracted into kicker/indexer 10*a* while push block 24*a* pushes pipe 16*a* up top surface 28*a* to clear past pipe dog 26*a*. In FIG. 13, pipe dog 26*a* is extended from top surface 28*a* so that pipe 16*a* can rest against it. This opens the space between backstop 22*a* and pipe dog 26*a* to allow kicker/indexer 10*a* to receive pipe 16*b*. In FIG. 14, pipe dog 26*a* is retracted to allow push block 26*a* to move pipes 16*a* and 16*b* towards trough 20 so that pipe 16*a* can roll into trough 20, as shown in FIG. 15. Push block 24*a* can be moved back so that pipe 16*b* can roll back and rest against pipe dog 26*a*.

Figure 16:
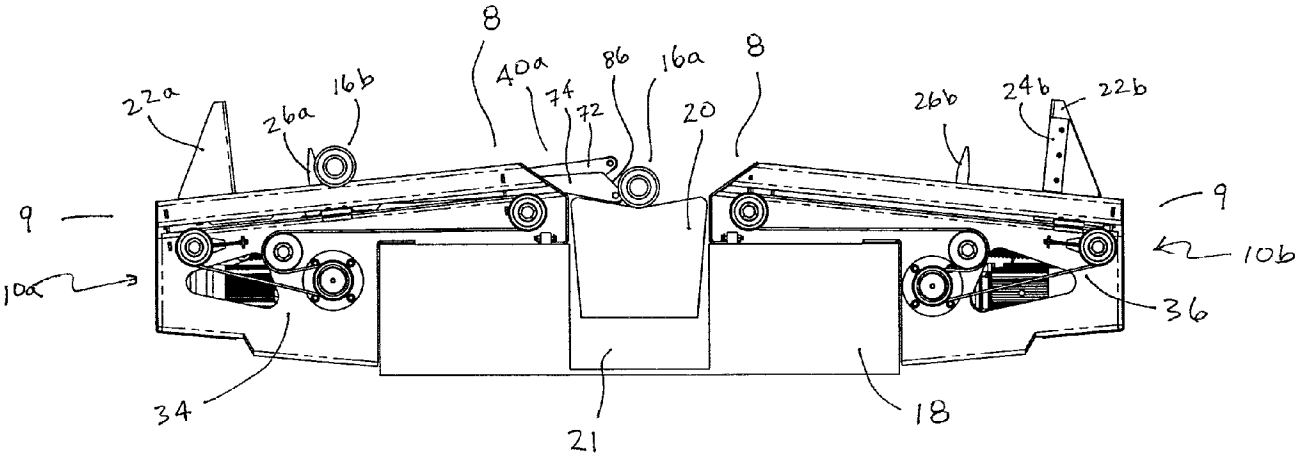
FIG. 16 is an end elevation view depicting the catwalk of FIG. 15 with the left kicker extending towards the pipe in the trough.
Figure 17:
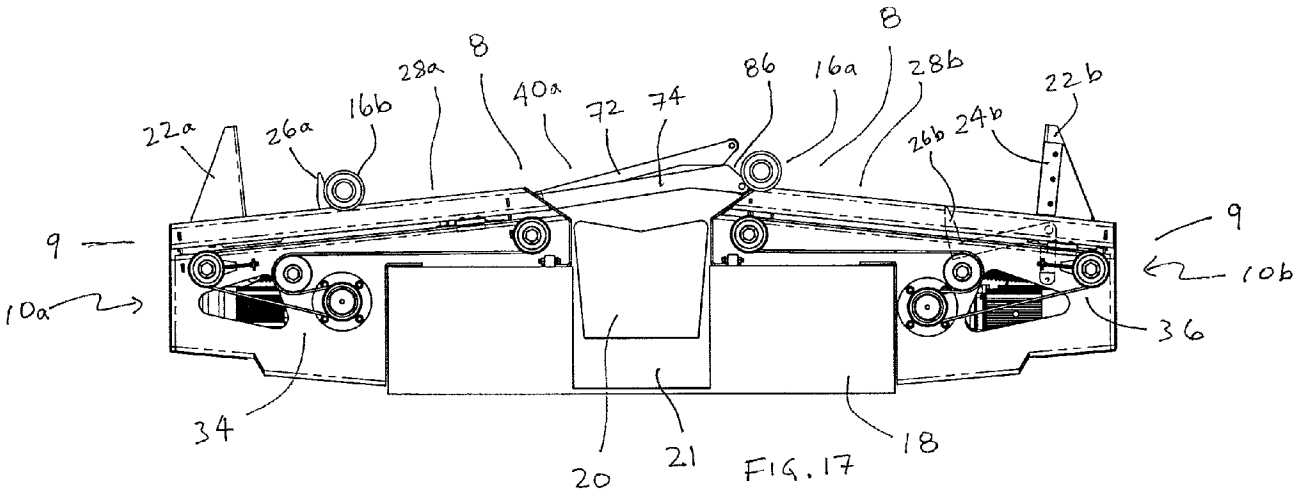
FIG. 17 is an end elevation view depicting the catwalk of FIG. 16 with the left kicker pushing the pipe in the trough up onto the top surface of the right kicker/indexer.
Figure 18:
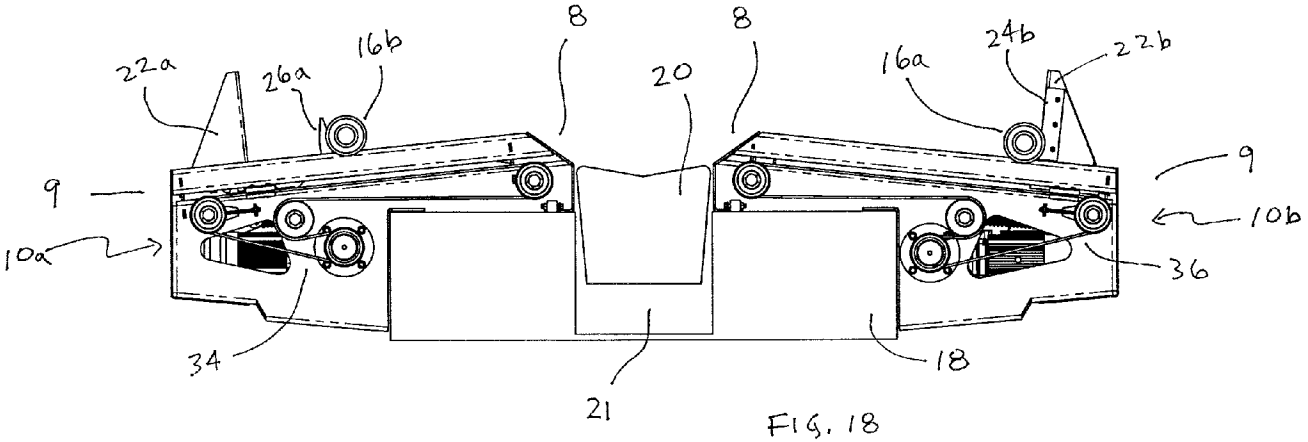
FIG. 18 is an end elevation view depicting the catwalk of FIG. 17 with one pipe resting against the right backstop and the other pipe resting against the left pipe dog.

Referring to FIG. 16, kicker arm 40*a* can be extended from kicker/indexer 10*a* to push pipe 16*a* from trough 20 towards kicker/indexer 10*b*. In FIG. 17, kicker arm 40*a* has extended far enough to push pipe 16*a* up onto top surface 28*b* whereupon kicker arm 40*a* can be retracted into kicker/indexer 10*a* and pipe 16*a* can roll down top surface 28*b* to rest against backstop 22*b*. The process can then be repeated until a plurality of pipe 16 can be placed on top surfaces 28*a* and 28*b*.

Figure 19:
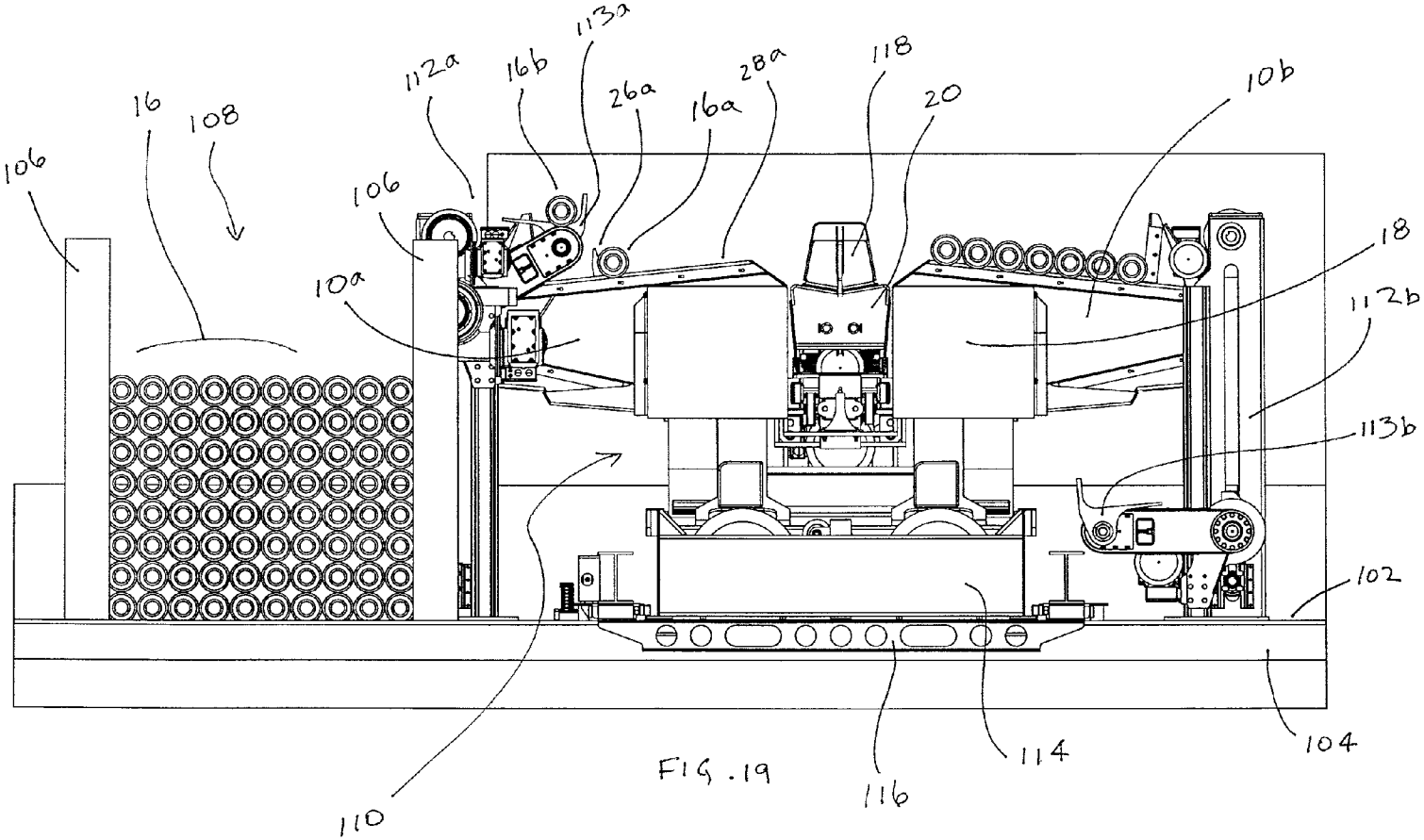
FIG. 19 is an end elevation view depicting a pipe handler with the catwalk and kicker/indexers of FIG. 1 positioned on a pipe deck of drilling rig and receiving pipe from a pipe rack.
Figure 20:
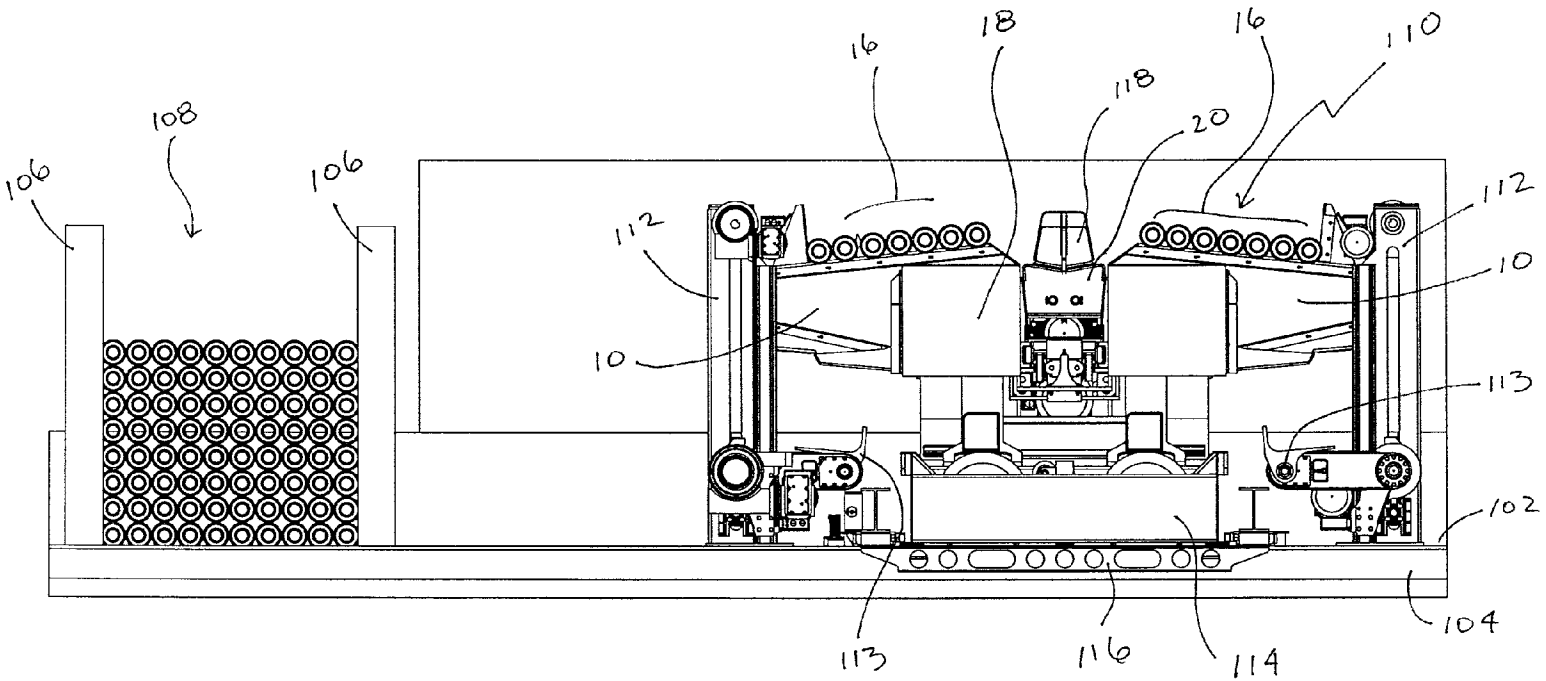
FIG. 20 is an end elevation view depicting the pipe handler of FIG. 19 skidded over on the pipe deck away from the pipe rack.

Referring now to FIGS. 19 to 24, the process of using catwalk 18 to move pipe 16 from a pipe rack to a drilling rig floor is illustrated. As shown in FIG. 19, pipe 16 is stored in pipe rack 108 between Samson posts 106. Pipe handler 110, comprising of catwalk 18 operatively connected to lower frame 114 and skidding system 116, is sitting on pipe beams 104 of pipe deck 102 adjacent to pipe rack 108. Pipe lifting unit 112*a* is shown moving pipe 16*b* onto kicker/indexer 10*a*. Pipe 16*a* is resting against pipe dog 26*a*. Tine 113*a* of lifting unit 112*a* can lower pipe 16*b* onto top surface 28*a* so that the process discussed above and shown in FIGS. 11 to 18 herein can be carried out. Once catwalk 18 has been loaded with pipe 16, pipe handler 110 can move or "skid" using skidding system 116 along pipe deck 102 to a predetermined position that can align trough 20 with the well bore on the drilling rig, as shown in FIG. 20.

For the purposes of this specification, skidding system 116 can comprise any known means to those skilled in the art for moving pipe handler 110 laterally across pipe deck 102. In some embodiments, skidding system 116 can move pipe handler 110 in the fore and aft directions as well as side to side so as to position pipe handler 110 relative to Samson posts 106 and pipe rack 108, as well as moving pipe handler 110 to a position in line with well bore 124 for delivering pipe between catwalk 18 and drilling rig floor 120. On some rigs, the location of pipe rack 108 can be at a distance relative to the edge of drilling rig floor 120 that requires moving pipe 16 longitudinally toward drilling rig floor 120 prior to lifting pipe 16 up to the drill floor height. Also, on some drilling rigs, the drill floor can move relative to pipe deck 102 to accommodate drilling multiple holes in an array formation. Thus, in some embodiments, skidding system 116 can enable pipe handler 110 to move on pipe deck 102 to move pipe between pipe rack 108 and drilling rig floor 120. In some embodiments, skidding system 116 can also enable pipe handler 110 to move stacks of pipe 16 on pipe deck 102 from one pipe rack to another without the use of a crane.

This can include something as simple as dragging pipe handler 110 across pipe deck 102 with cables or a crane (not shown), rolling pipe handler 110 across pipe deck 102 with a wheel and rail system (not shown), or as complex as a mechanical drive system (not shown) that can move pipe handler 110 to a desired position, laterally or fore and aft, on pipe deck 102.

Figure 21:
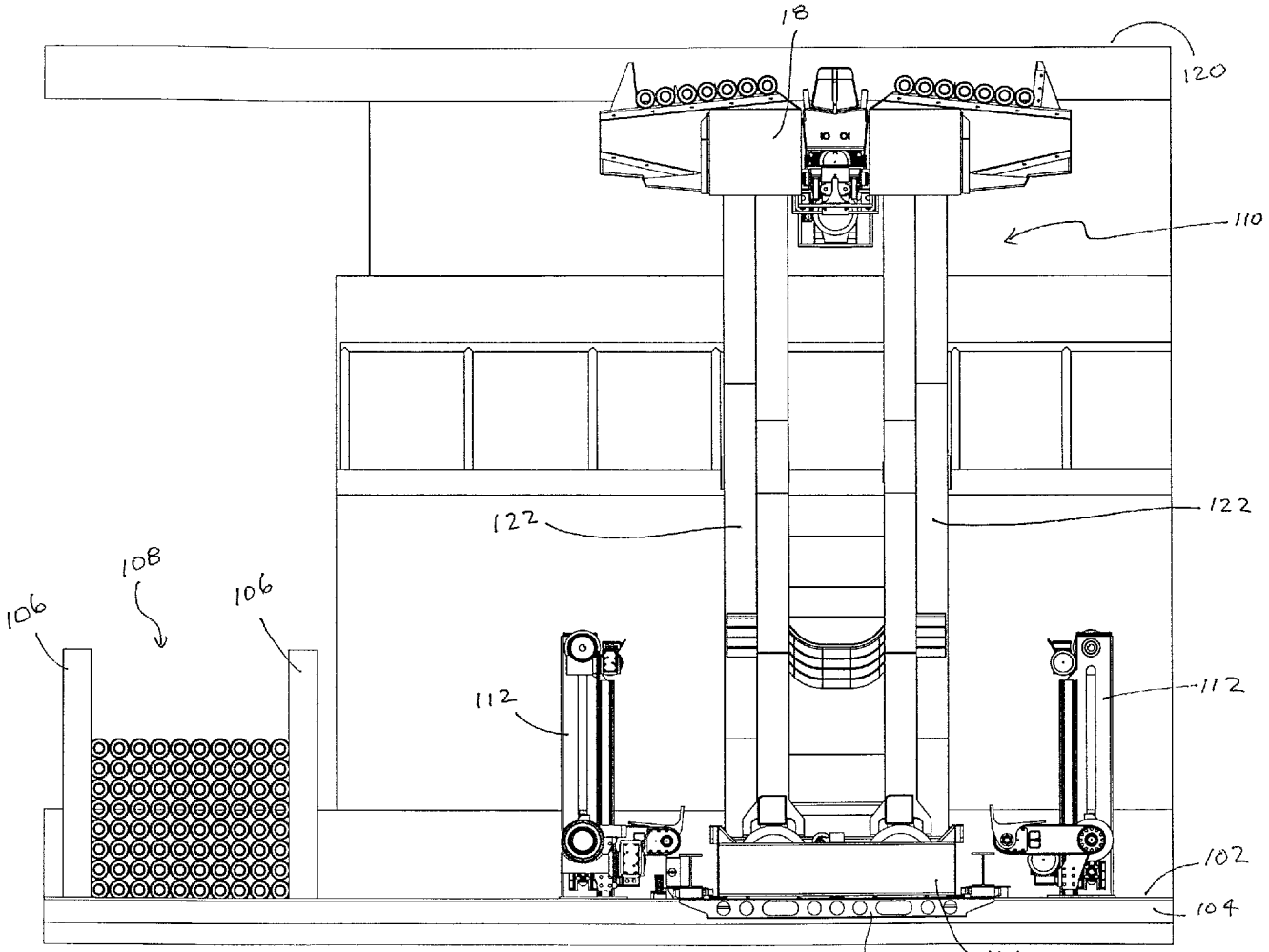
FIG. 21 is an end elevation view depicting the pipe handler of FIG. 20 extended upwards to present pipe to the drill floor of the drilling rig.
Figure 22:
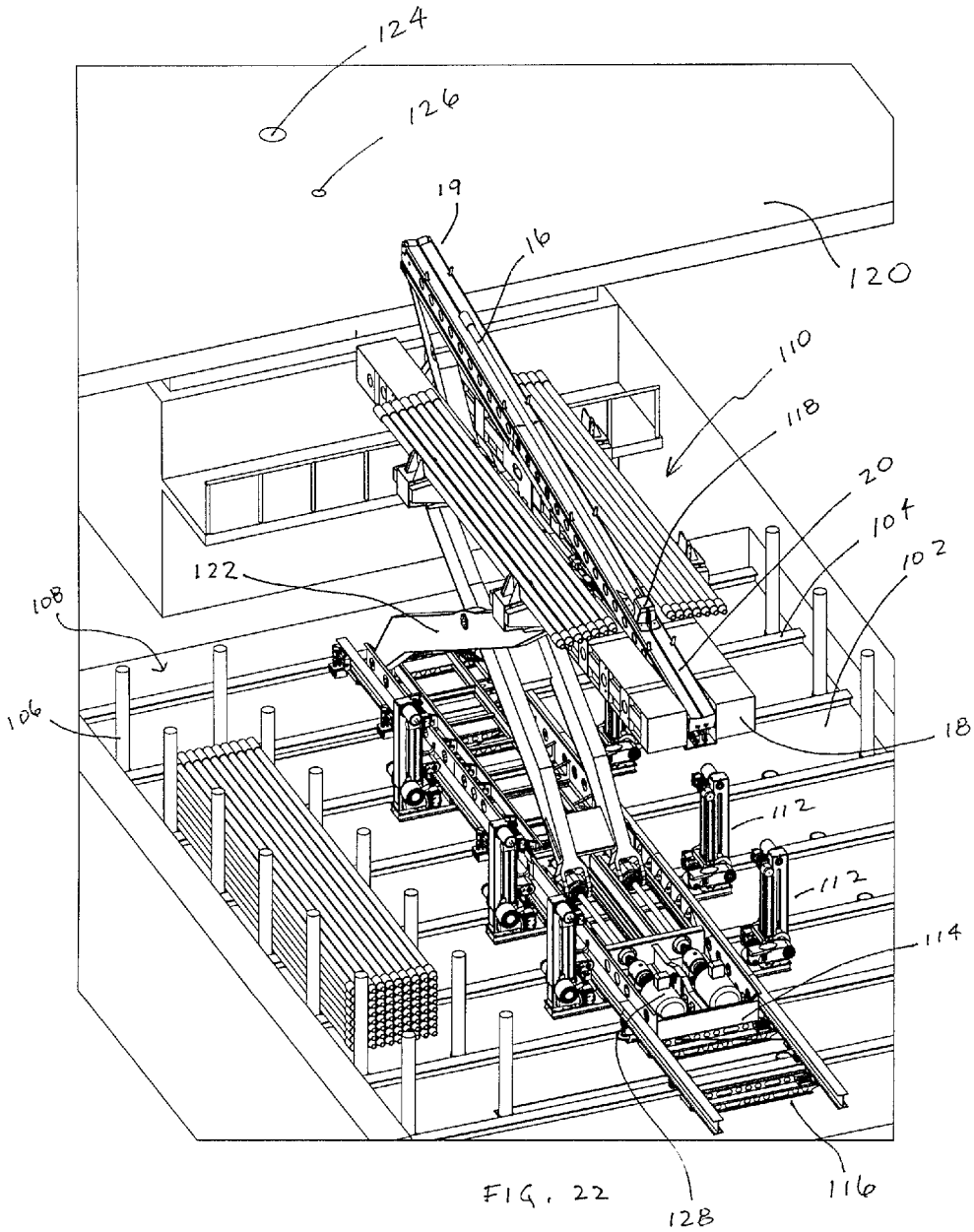
FIG. 22 is a rear perspective view depicting the pipe handler of FIG. 21 with the trough raised at the end nearer the drill floor.
Figure 23:
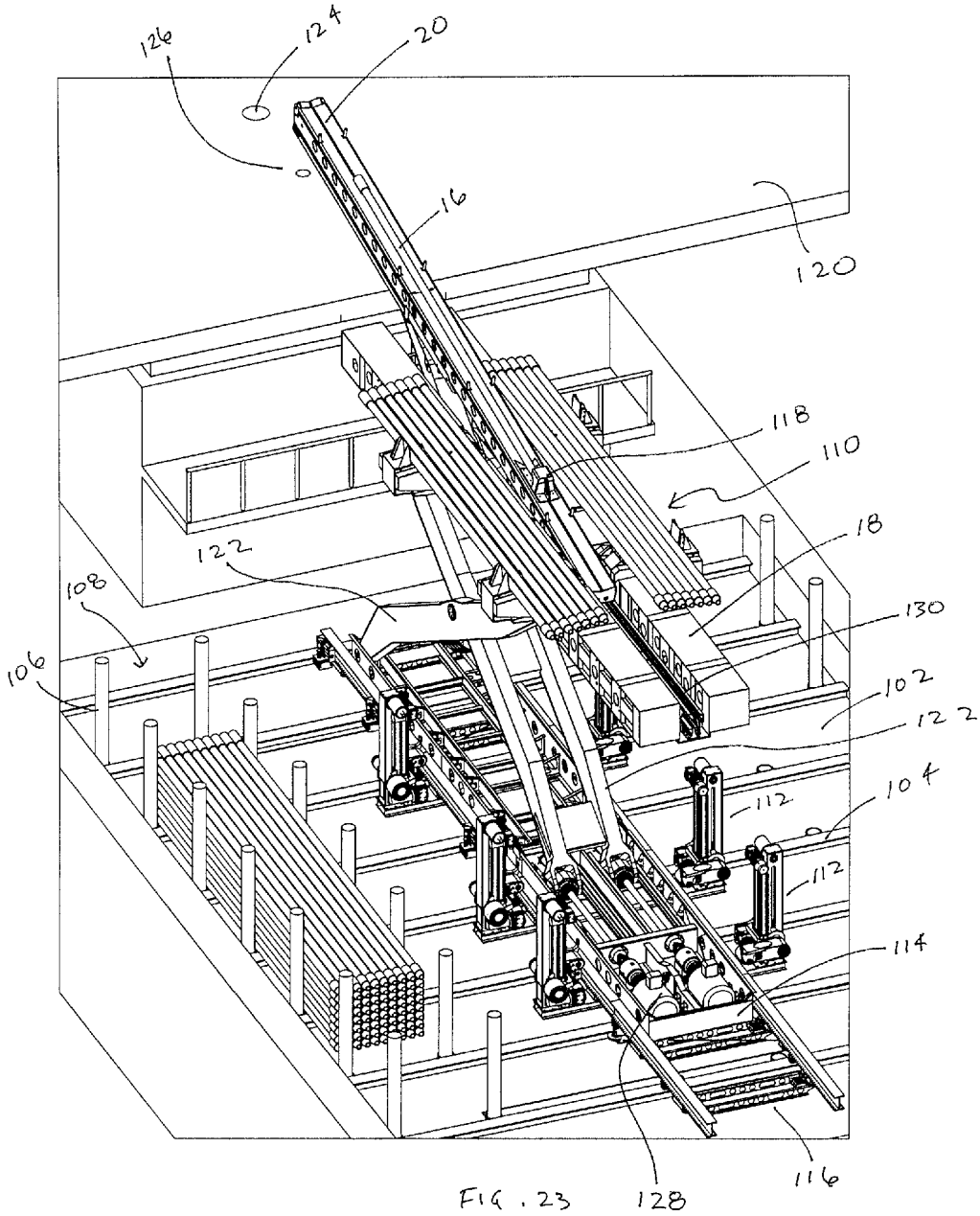
FIG. 23 is a rear perspective view depicting the pipe handler of FIG. 22 with the trough being extended towards the drill floor.
Figure 24:
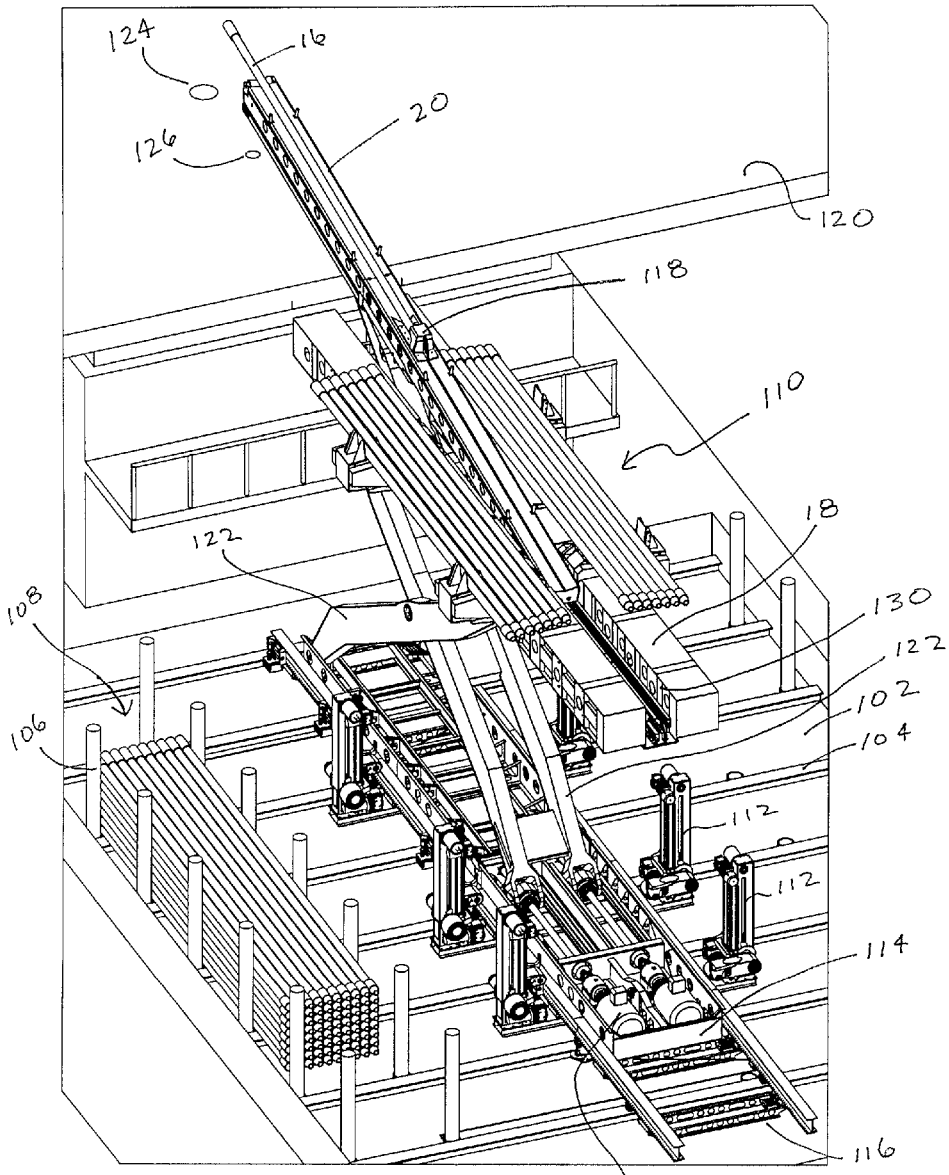
FIG. 24 is a rear perspective view depicting the pipe handler of FIG. 23 with the pipe being pushed up the trough by skate disposed in the trough.

Referring to FIG. 21, catwalk 18 is shown elevated with respect to lower frame 114 by actuating or extending legs 112 disposed therebetween. This places catwalk 18 in a position to present pipe 16 up to drilling rig floor 120. Referring to FIG. 22, pipe 16 is shown placed on trough 20, which can be carried out as described above and shown in FIGS. 11 to 18. Trough end 19 is shown being raised towards drilling rig floor 120. In this figure, it can be seen that trough 20 is in substantial alignment with well bore 124 and mouse hole 126 on drilling rig floor 120. In FIG. 23, trough 20 is shown having been moved along trough track 130 closer towards well bore 124. Once trough 20 has been moved to a predetermined position, skate 118 can then push pipe 16 up trough 20 where it can be picked off of trough 20 using equipment and techniques well known to those skilled in the art.

Figure 25:
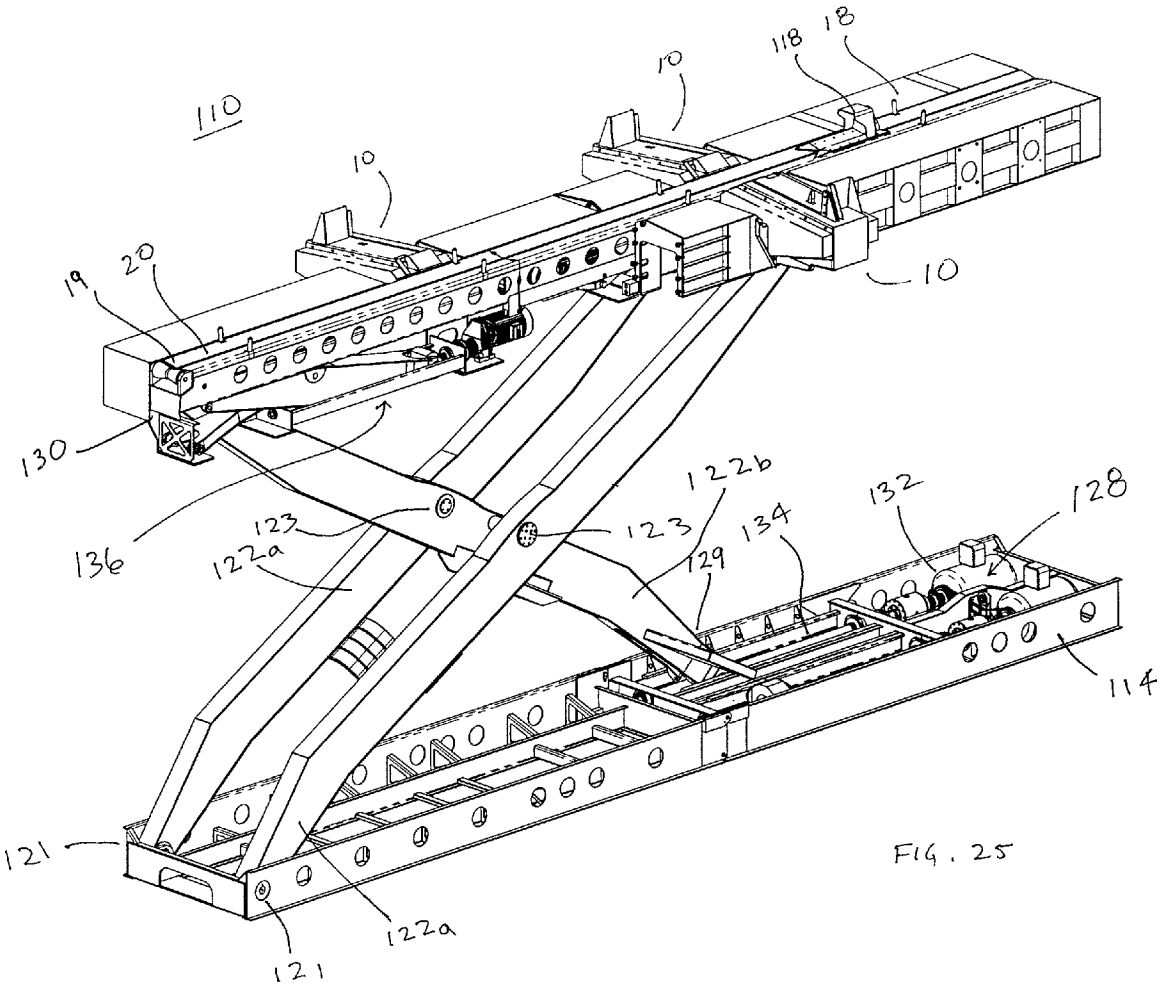
FIG. 25 is a front perspective view depicting the pipe handler of FIG. 21 with a front portion of the catwalk cut away and one half of one scissor leg removed.
Figure 26:
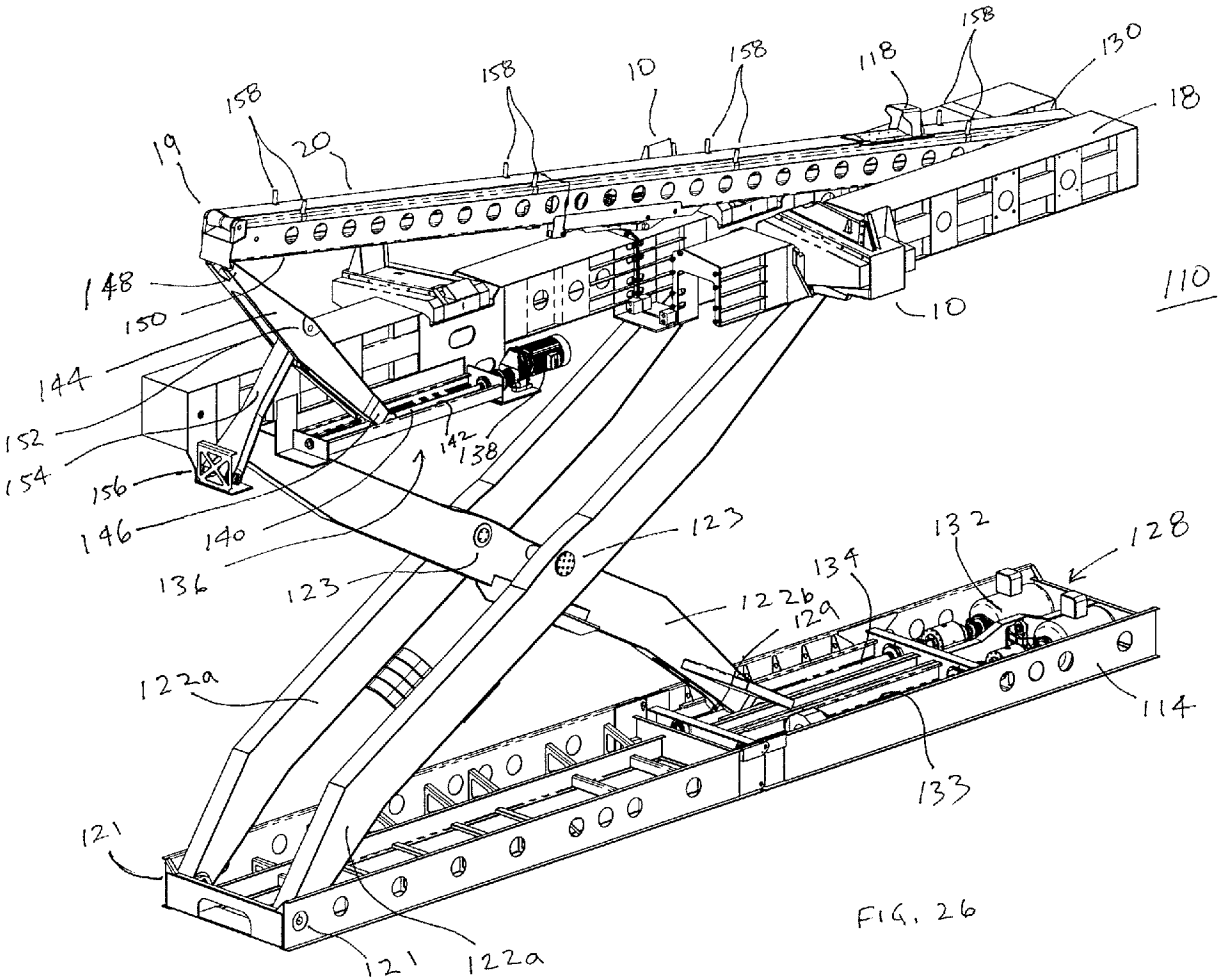
FIG. 26 is a front perspective view depicting the pipe handler of FIG. 22 with a front portion of the catwalk cut away and one half of one scissor leg removed.
Figure 27:
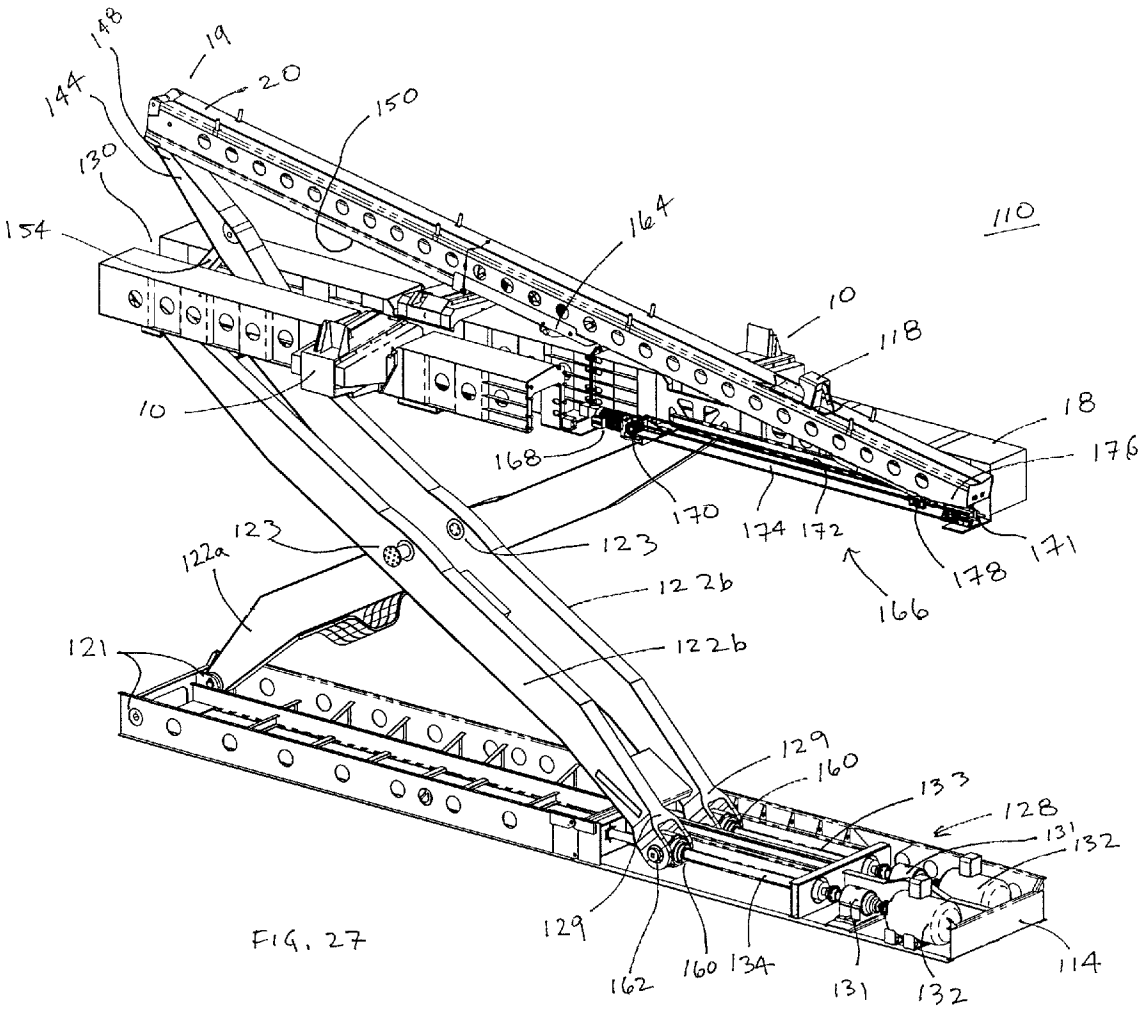
FIG. 27 is a rear perspective view depicting the pipe handler of FIG. 22 with a rear portion of the catwalk cut away and one half of one scissor leg removed.
Figure 28:
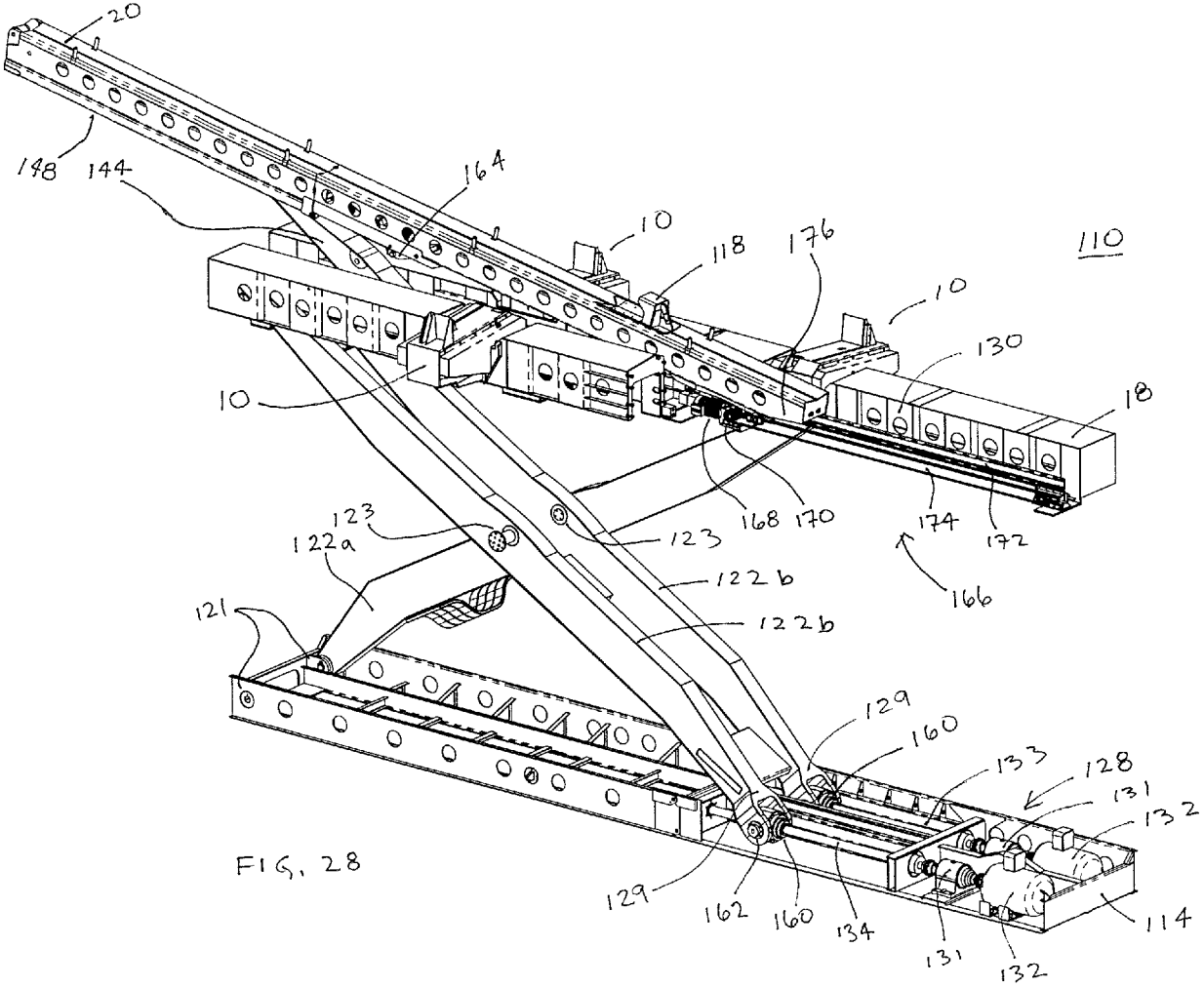
FIG. 28 is a rear perspective view depicting the pipe handler of FIG. 27 with the trough extended from the catwalk.

Referring to FIGS. 25 to 28, the components of one embodiment of pipe handler 110 are shown in more detail. In FIG. 25, pipe handler 110 is shown with catwalk 18 in a raised or elevated position by operation of scissor legs 122 pivotally attached via pins 123, which can be actuated by scissor leg drive assembly 128. In some embodiments, drive assembly 128 can comprise at least one motor 132 turning at least one screw-jack shaft 134 operatively coupled to scissor legs 122. Referring to FIGS. 27 and 28, the lower ends of scissor legs 122*b* can comprise crossheads 129 further comprise screw nuts 160 rotatably disposed therein for receiving screw-jack shafts 134. Crossheads 129 can further comprise rollers 162 configured to travel along guide tracks 133 disposed in lower frame 114. The lower end of scissor legs 122*a* can be pivotally attached to lower frame 114 via pins 121. When motors 132 are operated, screw-jack shafts 134 rotate and, depending on the rotation direction, the lower ends of legs 112*b* move away or towards motors 132, thereby resulting in the raising or lowering catwalk 18, respectively. In some embodiments, scissor leg drive assembly 128 can further comprise at least one gear reducer 131 operatively connecting motors 132 to screw-jack shafts 134. To prevent pipe from exiting trough 20 when catwalk 18 is being raised, trough 20 can further comprise safety pins 158 extend upwards from the top surface of trough 20, as shown in FIGS. 25 to 28. In further embodiments, pins 158 can be configured to retract into trough 20 when pipe 16 is being indexed into trough 20, and further extend upwards from trough 20 when catwalk 18 or trough 20 when pipe is being moved to and from drilling rig floor 120.

In some embodiments, catwalk 18 can further comprise trough lift assembly 136 that can raise trough end 19 from trough track 130, thereby tilting trough 20 with respect to catwalk 18, as shown in FIG. 26. In some embodiments, trough lift assembly 136 can comprise motor 138 that can turn screw-jack shaft 140, which can be threadably coupled to lower end 146 of lift beam 144. To enable the lifting of trough 20 at trough end 19, trough lift assembly 136 can further comprise crank beam 154 pivotally attached to lift beam 144 at pivot pin 152, and further pivotally attached to catwalk 18 at lower pivot pin 156. Upper end 148 of lift beam 144 can be operatively coupled to the bottom of trough 20. When motor 138 is operated, screw-jack shaft 140 turns resulting in lower end 146 moving away from motor 138 and lifting trough end 19 by pivoting on crank beam 154.

Referring to FIG. 27, catwalk 18 is shown with a rear portion cutaway to reveal trough drive assembly 166. In some embodiments, trough 20 can move along trough track 130 by operating trough drive assembly 166. In some embodiments, trough drive assembly 166 can comprise motor 168 turning drive pulley 170 thereby rotating belt 174, passing around pulley 171, beneath trough 20. Lower end 176 of trough 20 can attach to belt 174 with attachment plate 178. Operating motor 168 causes belt 174 to move thereby moving trough 20 along trough track 130. Rollers disposed on lower end 176 (not shown) can travel along guide channel 172 as it moves along trough track 130. Upper end 148 of lift beam 144 can further comprise rollers (not shown) that can travel along guide channels 150 disposed on the underside of trough 20 thereby enabling trough 19 to extend forward, as shown in FIG. 28, as trough 20 is moved along trough track 130.

In the reverse operation, pipe handler 110 can accept and retrieve pipe 16 from the drilling rig floor, and store multiple pipe in a single layer across catwalk 18, then lower them down to pipe deck 102 where they can be returned to pipe rack 108.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A kicker/indexer for a pipe handler comprising a catwalk and a trough configured to receive pipe, the trough disposed along a longitudinal axis extending along the catwalk, the kicker/indexer comprising:

a) a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame;

b) a push block assembly for indexing or moving pipe along the top surface from the backstop to the trough, wherein the push block assembly further comprises a push block disposed on the top surface, the push block configured to move along the top surface from the backstop to the trough end of the frame, the push block assembly further comprising:

i) a push block drive assembly operatively coupled to the push block, ii) a first continuous loop drive mechanism, and iii) a first motor configured for driving the first continuous loop drive mechanism;

c) a kicker assembly for kicking out pipe located in the trough; and d) a first transmission operatively coupling the first motor to the first continuous loop drive mechanism.

2. The kicker/indexer as set forth in claim 1, wherein the first continuous loop drive mechanism comprises one or more of the group consisting of belts and pulleys, chains and sprockets, cables and pulleys, rack and pinion gears, and intermeshing gears.

3. The kicker/indexer as set forth in claim 1, further comprising a first tensioner for tensioning the first continuous loop drive mechanism.

4. The kicker/indexer as set forth in claim 1, wherein the first motor comprises one or more of the group consisting of AC fixed frequency motors, AC variable frequency electric motors, DC motors, stepper motors, hydraulic motors and pneumatic motors.

5. The kicker/indexer as set forth in claim 1, wherein the kicker assembly further comprises a kicker arm slidably disposed within the frame, the kicker arm configured to extend from the frame to kick pipe from the trough and to substantially retract into the frame.

6. The kicker/indexer as set forth in claim 5, wherein the kicker assembly further comprises a kicker drive assembly operatively coupled to the kicker arm.

7. The kicker/indexer as set forth in claim 6, wherein the kicker drive assembly further comprises a second continuous loop drive mechanism.

8. The kicker/indexer as set forth in claim 7, wherein the second continuous loop drive mechanism comprises one or more of the group consisting of belts and pulleys, chains and sprockets, cables and pulleys, rack and pinion gears, and intermeshing gears.

9. The kicker/indexer as set forth in claim 7, further comprising a second tensioner for tensioning the second continuous loop drive mechanism.

10. The kicker/indexer as set forth in claim 7, wherein the kicker assembly further comprises a second motor configured for driving the second continuous loop drive mechanism.

11. The kicker/indexer as set forth in claim 10, wherein the second motor comprises one or more of the group consisting of AC fixed frequency motors, AC variable frequency electric motors, DC motors, stepper motors, hydraulic motors and pneumatic motors.

12. The kicker/indexer as set forth in claim 10, further comprising a second transmission operatively coupling the second motor to the second continuous loop drive mechanism.

13. The kicker/indexer as set forth in claim 1, further comprising a pipe dog disposed within the frame, the pipe dog configured to extend upwards from the top surface and to retract into the frame.

14. The kicker/indexer as set forth in claim 13, wherein the pipe dog is operatively coupled to the kicker assembly.

15. An improved pipe handler comprising a catwalk for use on a pipe deck on a drilling rig, the pipe handler configured for moving pipe disposed on the pipe deck to a drilling rig floor, the improvement comprising at least one kicker/indexer disposed on the catwalk, the at least one kicker/indexer comprising:

a) a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame;

b) a push block assembly for indexing or moving pipe along the top surface from the backstop to the trough, wherein the push block assembly further comprises a push block disposed on the top surface, the push block configured to move along the top surface from the backstop to the trough end of the frame, the push block assembly further comprising:

i) a push block drive assembly operatively coupled to the push block, ii) a first continuous loop drive mechanism, and iii) a first motor configured for driving the first continuous loop drive mechanism;

c) a kicker assembly for kicking out pipe located in the trough; and d) a first transmission operatively coupling the first motor to the first continuous loop drive mechanism.

16. The improved pipe handler as set forth in claim 15, wherein the first continuous loop drive mechanism comprises one or more of the group consisting of belts and pulleys, chains and sprockets, cables and pulleys, rack and pinion gears, and intermeshing gears.

17. The improved pipe handler as set forth in claim 15, further comprising a first tensioner for tensioning the first continuous loop drive mechanism.

18. The improved pipe handler as set forth in claim 15, wherein the first motor comprises one or more of the group consisting of AC fixed frequency motors, AC variable frequency electric motors, DC motors, stepper motors, hydraulic motors and pneumatic motors.

19. The improved pipe handler as set forth in claim 15, wherein the kicker assembly further comprises a kicker arm slidably disposed within the frame, the kicker arm configured to extend from the frame to kick pipe from the trough and to substantially retract into the frame.

20. The improved pipe handler as set forth in claim 19, wherein the kicker assembly further comprises a kicker drive assembly operatively coupled to the kicker arm.

21. The improved pipe handler as set forth in claim 20, wherein the kicker drive assembly further comprises a second continuous loop drive mechanism.

22. The improved pipe handler as set forth in claim 21, wherein the second continuous loop drive mechanism comprises one or more of the group consisting of belts and pulleys, chains and sprockets, cables and pulleys, rack and pinion gears, and intermeshing gears.

23. The improved pipe handler as set forth in claim 21, further comprising a second tensioner for tensioning the second continuous loop drive mechanism.

24. The improved pipe handler as set forth in claim 21, wherein the kicker assembly further comprises a second motor configured for driving the second continuous loop drive mechanism.

25. The improved pipe handler as set forth in claim 24, wherein the second motor comprises one or more of the group consisting of AC fixed frequency motors, AC variable frequency electric motors, DC motors, stepper motors, hydraulic motors and pneumatic motors.

26. The improved pipe handler as set forth in claim 24, further comprising a second transmission operatively coupling the second motor to the second continuous loop drive mechanism.

27. The improved pipe handler as set forth in claim 15, further comprising a pipe dog disposed within the frame, the pipe dog configured to extend upwards from the top surface and to retract into the frame.

28. The improved pipe handler as set forth in claim 27, wherein the pipe dog is operatively coupled to the kicker assembly.

29. A pipe handler for use on a pipe deck on a drilling rig for moving pipe disposed on the pipe deck to a drilling rig floor, comprising:

a) a catwalk operatively coupled to a lower frame with a pair of scissor legs wherein the catwalk can be raised and lowered with respect to the lower frame by operating a scissor legs drive assembly operatively coupled to the scissor legs, the catwalk further comprising:

i) a frame configured for attaching to the catwalk, the frame comprising a trough end and a catwalk end, the trough end configured to be disposed near the trough, the frame further comprising a top surface that slopes downwardly away from the trough end to catwalk end, the frame further comprising a backstop disposed on the catwalk end, the backstop configured to keep pipe from sliding off of the frame, ii) a push block assembly for indexing or moving pipe along the top surface from the backstop to the trough, wherein the push block assembly further comprises a push block disposed on the top surface, the push block configured to move along the top surface from the backstop to the trough end of the frame, the push block assembly further comprising a push block drive assembly operatively coupled to the push block, a first continuous loop drive mechanism and a first motor configured for driving the first continuous loop drive mechanism, iii) a kicker assembly for kicking out pipe located in the trough, and iv) a first transmission operatively coupling the first motor to the first continuous loop drive mechanism;

b) a trough nested within a trough guide track disposed along a longitudinal axis of the catwalk, the trough comprising two ends, a first end disposed nearer the drilling rig floor and a second end disposed away from the drilling rig floor, the trough configured to move within the trough guide track;

c) a trough lift drive assembly disposed within the catwalk, the trough lift drive assembly configured to raise the first end of the trough; and d) a trough drive assembly disposed within the catwalk, the trough drive assembly operatively coupled to the second end and configured to move the trough along the trough guide track.

30. The pipe handler as set forth in claim 29, wherein the first continuous loop drive mechanism comprises one or more of the group consisting of belts and pulleys, chains and sprockets, cables and pulleys, rack and pinion gears, and intermeshing gears.

31. The pipe handler as set forth in claim 29, further comprising a first tensioner for tensioning the first continuous loop drive mechanism.

32. The pipe handler as set forth in claim 29, wherein the first motor comprises one or more of the group consisting of AC fixed frequency motors, AC variable frequency electric motors, DC motors, stepper motors, hydraulic motors and pneumatic motors.

33. The pipe handler as set forth in claim 29, wherein the kicker assembly further comprises a kicker arm slidably disposed within the frame, the kicker arm configured to extend from the frame to kick pipe from the trough and to substantially retract into the frame.

34. The pipe handler as set forth in claim 33, wherein the kicker assembly further comprises a kicker drive assembly operatively coupled to the kicker arm.

35. The pipe handler as set forth in claim 34, wherein the kicker drive assembly further comprises a second continuous loop drive mechanism.

36. The pipe handler as set forth in claim 35, wherein the second continuous loop drive mechanism comprises one or more of the group consisting of belts and pulleys, chains and sprockets, cables and pulleys, rack and pinion gears, and intermeshing gears.

37. The pipe handler as set forth in claim 35, further comprising a second tensioner for tensioning the second continuous loop drive mechanism.

38. The pipe handler as set forth in claim 35, wherein the kicker assembly further comprises a second motor configured for driving the second continuous loop drive mechanism.

39. The pipe handler as set forth in claim 38, wherein the second motor comprises one or more of the group consisting of AC fixed frequency motors, AC variable frequency electric motors, DC motors, stepper motors, hydraulic motors and pneumatic motors.

40. The pipe handler as set forth in claim 38, further comprising a second transmission operatively coupling the second motor to the second continuous loop drive mechanism.

41. The pipe handler as set forth in claim 29, further comprising a pipe dog disposed within the frame, the pipe dog configured to extend upwards from the top surface and to retract into the frame.

42. The pipe handler as set forth in claim 41, wherein the pipe dog is operatively coupled to the kicker assembly.

* * * * *